US008668309B2

(12) United States Patent
Usuda et al.

(10) Patent No.: US 8,668,309 B2
(45) Date of Patent: Mar. 11, 2014

(54) FLUID EJECTING APPARATUS AND FLUID EJECTING METHOD

(75) Inventors: Hidenori Usuda, Matsumoto (JP); Yoshihiko Matsuzawa, Matsumoto (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 336 days.

(21) Appl. No.: 12/968,205

(22) Filed: Dec. 14, 2010

(65) Prior Publication Data

US 2011/0141174 A1 Jun. 16, 2011

(30) Foreign Application Priority Data

Dec. 15, 2009 (JP) ..... 2009-284396
Apr. 2, 2010 (JP) ..... 2010-086399

(51) Int. Cl.
*B41J 2/21* (2006.01)

(52) U.S. Cl.
USPC ..... 347/43; 347/14; 347/15

(58) Field of Classification Search
USPC ..... 347/5, 9, 14, 15, 43
See application file for complete search history.

(56) References Cited

U.S. PATENT DOCUMENTS

| | | | | |
|---|---|---|---|---|
| 4,089,800 | A | 5/1978 | Temple | |
| 4,425,405 | A | 1/1984 | Murakami et al. | |
| 4,592,954 | A | 6/1986 | Malhotra | |
| 4,650,714 | A | 3/1987 | Kojima et al. | |
| 4,902,577 | A | 2/1990 | Butters et al. | |
| 5,241,006 | A | 8/1993 | Iqbal et al. | |
| 5,389,723 | A | 2/1995 | Iqbal et al. | |
| 5,472,773 | A | 12/1995 | Misuda et al. | |
| 5,725,961 | A | 3/1998 | Ozawa et al. | |
| 6,114,411 | A | 9/2000 | Nakamura et al. | |
| 7,015,259 | B2 | 3/2006 | Kataoka et al. | |
| 7,211,132 | B2 | 5/2007 | Oki et al. | |
| 7,357,483 | B2 * | 4/2008 | Ide et al. | 347/43 |
| 7,407,277 | B2 | 8/2008 | Yoneyama | |
| 7,562,957 | B2 * | 7/2009 | Mills et al. | 347/15 |
| 2002/0171709 | A1 | 11/2002 | Teshigawara et al. | |
| 2007/0188547 | A1 | 8/2007 | Kobayashi et al. | |
| 2009/0000511 | A1 | 1/2009 | Kitamura et al. | |
| 2010/0302299 | A1 | 12/2010 | Kobayashi et al. | |

FOREIGN PATENT DOCUMENTS

| | | | |
|---|---|---|---|
| JP | 57-038185 | A | 3/1982 |
| JP | 60-168651 | A | 9/1985 |
| JP | 60-171143 | A | 9/1985 |
| JP | 60-232990 | A | 11/1985 |

(Continued)

*Primary Examiner* — Lam S Nguyen
(74) *Attorney, Agent, or Firm* — Kilpatrick Townsend & Stockton LLP

(57) ABSTRACT

An apparatus includes: a first nozzles for ejecting first fluid are lined up in a predetermined direction; a second nozzles for ejecting second fluid are lined up in a movement direction; and a control unit which sets a first method of when formation of a main image with the first fluid and formation of a background image with the second fluid are performed to overlap the main image and the background image with each other on the medium, in a case where one of the nozzle group of the part of the first nozzles and the nozzle group of the part of the second nozzles is positioned closer to the other direction side of the predetermined direction than the other nozzle group to perform the image formation on a predetermined area of the medium in advance of the other nozzle group.

8 Claims, 10 Drawing Sheets

(56) References Cited

FOREIGN PATENT DOCUMENTS

| | | | |
|---|---|---|---|
| JP | 60-234879 | A | 11/1985 |
| JP | 60-245588 | A | 12/1985 |
| JP | 61-074879 | A | 4/1986 |
| JP | 61-132377 | A | 6/1986 |
| JP | 61-134290 | A | 6/1986 |
| JP | 61-181679 | A | 8/1986 |
| JP | 62-184879 | A | 8/1987 |
| JP | 62-220383 | A | 9/1987 |
| JP | 3-24906 | B2 | 4/1991 |
| JP | 04-214382 | A | 8/1992 |
| JP | 04-282282 | A | 10/1992 |
| JP | 04-285650 | A | 10/1992 |
| JP | 06-199035 | A | 7/1994 |
| JP | 7-047695 | A | 2/1995 |
| JP | 07-082694 | A | 3/1995 |
| JP | 09-099634 | A | 4/1997 |
| JP | 09-208870 | A | 8/1997 |
| JP | 10-203006 | A | 8/1998 |
| JP | 11-129613 | A | 5/1999 |
| JP | 11-140365 | A | 5/1999 |
| JP | 2001-234093 | A | 8/2001 |
| JP | 2001-328344 | A | 11/2001 |
| JP | 2002-038063 | A | 2/2002 |
| JP | 2003-034021 | A | 2/2003 |
| JP | 2003-292834 | A | 10/2003 |
| JP | 3562754 | B2 | 6/2004 |
| JP | 3639479 | B2 | 1/2005 |
| JP | 2005-105135 | A | 4/2005 |
| JP | 2007-050555 | A | 3/2007 |
| JP | 2008-081693 | A | 4/2008 |
| JP | 2009-000925 | A | 1/2009 |

* cited by examiner

FLUID EJECTING APPARATUS AND FLUID EJECTING METHOD

Priority is claimed under 35 U.S.C §119 to Japanese Application No. 2009-284396 filed on Dec. 15, 2009, and No. 2010-086399 filed on Apr. 2, 2010, which are hereby incorporated by reference in their entireties.

BACKGROUND

1. Technical Field

The present invention relates to a fluid ejecting apparatus and a fluid ejecting method.

2. Related Art

As a fluid ejecting apparatus, there is an ink jet printer (hereinafter, referred to as a printer) having a nozzle row in which nozzles for ejecting ink (fluid) onto a medium are arrayed in a predetermined direction. As the printer, a printer which repeatedly performs an image formation operation of ejecting ink from the nozzles while moving the nozzle row in a movement direction intersecting the predetermined direction and a transport operation of transporting the medium in a transport direction which is the predetermined direction is known.

In addition, a printing apparatus for performing printing using white ink as well as color inks including cyan, magenta, and yellow colors is known (for example, refer to JP-A-2002-38063). In such a printer, for example, a background image printed with the white ink and a color image are overlapped to be printed, and thus a color image with good color developing property can be printed without being influenced by a background color of the medium. Accordingly, there is a printer which performs printing by selecting one from a "white use mode" of printing a background image and a color image to be overlapped and a "color mode" of printing only a color image.

When the white use mode is selected, nozzles for one image from among the background image and the color image which is to be printed onto the medium in advance are set to nozzles on an upstream side of the medium transport direction from nozzles for the other image which is to be printed later. Accordingly, the image formation operation of forming the background image and the image formation operation of forming the color image are performed differently. However, although the image formation operations of printing the background image and the color image are performed differently, in a case where the image is formed while the nozzle row is moved bidirectionally in a movement direction, a time interval to form the background image and the color image is short, and oozing of the image and a mixed color therein may occur.

SUMMARY

An advantage of some aspects of the invention is to suppress oozing of an image or a mixed color.

According to an aspect of the invention, there is provided a fluid ejecting apparatus including: a first nozzle row in which nozzles for ejecting a first fluid are lined up in a predetermined direction; a second nozzle row in which nozzles for ejecting a second fluid are lined up in the predetermined direction and which is lined up in a movement direction intersecting the predetermined direction with respect to the first nozzle row; and a control unit which sets one of a first image formation method of repeatedly performing an ejecting operation of ejecting fluid from the nozzles while relatively moving relative positions of the first and second nozzle rows and a medium in one direction of the movement direction and a moving operation of relatively moving the relative positions of the first and second nozzle rows and the medium in one direction of the predetermined direction, and a second image formation method of repeatedly performing an operation of ejecting fluid from the nozzles while relatively moving the relative positions of the first and second nozzle rows and the medium in both directions of the movement direction and the moving operation to form an image on the medium, wherein the control unit sets the first image formation method when formation of a main image with the first fluid by a nozzle group of a part of the first nozzle row and formation of a background image with the second fluid by a nozzle group of a part of the second nozzle row and the first fluid by the nozzles in the first nozzle row at the same position in the predetermined direction as the corresponding nozzle group of the part of the second nozzle row are performed to overlap the main image and the background image with each other on the medium, in a case where one of the nozzle group of the part of the first nozzle row and the nozzle group of the part of the second nozzle row is positioned closer to the other direction side of the predetermined direction than the other nozzle group to perform the image formation on a predetermined area of the medium in advance of the other nozzle group.

Further features of the invention will become apparent from the following description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
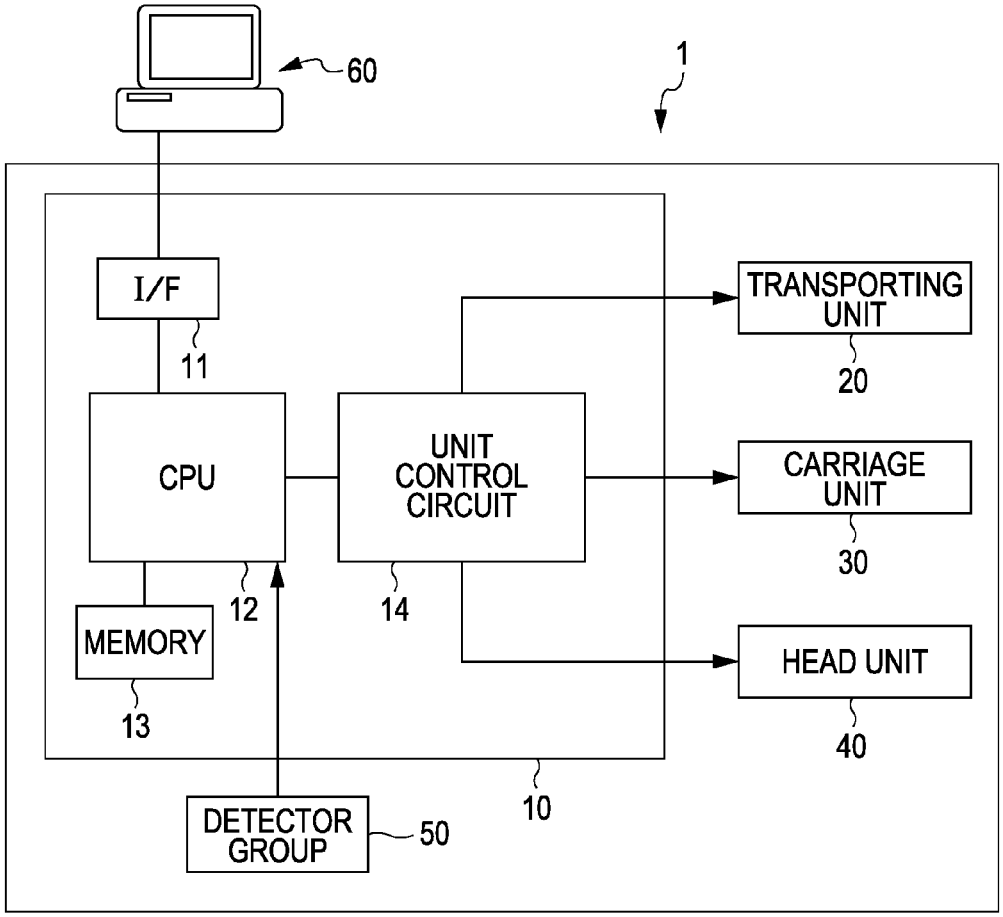
FIG. 1 is a block diagram of the entire configuration of a printer.

At least the following features will become apparent from the description of the specification and the accompanying drawings.

That is, there is provided a fluid ejecting apparatus including: a first nozzle row in which nozzles for ejecting a first fluid are lined up in a predetermined direction; a second nozzle row in which nozzles for ejecting a second fluid are lined up in the predetermined direction and which is lined up in a movement direction intersecting the predetermined direction with respect to the first nozzle row; and a control unit which sets one of a first image formation method of repeatedly performing an ejecting operation of ejecting fluid from the nozzles while relatively moving relative positions of the first and second nozzle rows and a medium in one direction of the movement direction and a moving operation of relatively moving the relative positions of the first and second nozzle rows and the medium in one direction of the predetermined direction, and a second image formation method of repeatedly performing an operation of ejecting fluid from the nozzles while relatively moving the relative positions of the first and second nozzle rows and the medium in both directions of the movement direction and the moving operation to form an image on the medium, wherein the control unit sets the first image formation method when formation of a main image with the first fluid by a nozzle group of a part of the first nozzle row and formation of a background image with the second fluid by a nozzle group of a part of the second nozzle row are performed to overlap the main image and the background image with each other on the medium, in a case where one of the nozzle group of the part of the first nozzle row and the nozzle group of the part of the second nozzle row is positioned closer to the other direction side of the predetermined direction than the other nozzle group to perform the image formation on a predetermined area of the medium in advance of the other nozzle group.

According to the fluid ejecting apparatus, oozing of the image and mixed colors can be suppressed.

In the fluid ejecting apparatus, in the first image formation method, a time needed to perform a returning operation of relatively moving the relative positions of the first and second nozzle rows and the medium in the other direction of the movement direction and not ejecting fluid from the nozzle is longer than a time needed to perform the moving operation once.

According to the fluid ejecting apparatus, the drying time of the image formed in advance from among the main image and the background image can be lengthened in the first image formation method compared to the second image formation method.

In the fluid ejecting apparatus, in the first image formation method, a time needed to perform a returning operation of relatively moving the relative positions of the first and second nozzle rows and the medium in the other direction of the movement direction and not ejecting fluid from the nozzles is equal to or shorter than a time needed to perform the ejecting operation once, and is longer than a time needed to relatively move the relative positions of the first and second nozzle rows and the medium in the one direction of the predetermined direction by a length of the nozzle group in the predetermined direction.

According to the fluid ejecting apparatus, the drying time of the image formed in advance from among the main image and the background image can be lengthened in the first image formation method compared to the second image formation method.

In the fluid ejecting apparatus, a time needed to perform the returning operation in the first image formation method is longer than a time needed to relatively move the relative positions of the first and second nozzle rows and the medium in the one direction of the predetermined direction by a length in the predetermined direction of at least one of the nozzle rows of the first and second nozzle rows.

According to the fluid ejecting apparatus, the drying time of the image formed in advance from among the main image and the background image can be lengthened in the first image formation method compared to the second image formation method.

In the fluid ejecting apparatus, in the first image formation method, the returning operation of relatively moving the relative positions of the first and second nozzle rows and the medium in the other direction of the movement direction and not ejecting fluid from the nozzles is not performed simultaneously with the moving operation.

According to the fluid ejecting apparatus, the drying time of the image formed in advance from among the main image and the background image can be lengthened, and the returning operation and the moving operation can be performed with good precision.

In the fluid ejecting apparatus, the control unit sets the second image formation method in the case where the main image is formed on the medium without forming the background image.

According to the fluid ejecting apparatus, the image formation time can be reduced.

In the fluid ejecting apparatus, the second nozzle row is positioned on a first direction side of the movement direction from the first nozzle row. When the main image and the background image are to be formed on the medium to be overlapped, the control unit sets one of a first mode in which the background image is formed in advance of the main image on the predetermined area of the medium, and a second mode in which the main image is formed in advance of the background image on the predetermined area of the medium. When the first mode is set, fluid is ejected from the nozzles when the relative positions of the first and second nozzle rows and the medium are relatively moved in the first direction of the movement direction. When the second mode is set, fluid is ejected from the nozzles when the relative positions of the first and second nozzle rows and the medium are relatively moved in a second direction of the movement direction.

According to the fluid ejecting apparatus, a formation order of images on a medium area corresponding to a boundary line between the nozzles for forming the main image and the nozzles for forming the background image can be made to be the same as that of other medium areas.

In the fluid ejecting apparatus, the background image is formed using the nozzles in the first nozzle row of which a position in the predetermined direction is the same as that of the nozzle group of the part of the second nozzle row for forming the background image, in the case where the formation of the main image and the formation of the background image are performed to overlap the main image and the background image with each other on the medium.

According to the fluid ejecting apparatus, the background image with a desired color can be formed.

According to another aspect of the invention, there is provided a fluid ejecting method including: setting one of a first image formation method of repeatedly performing an ejecting operation of ejecting fluid from the nozzles while relatively moving relative positions of a first row in which nozzles for ejecting first fluid are lined up in a predetermined direction, a second nozzle row in which nozzles for ejecting second fluid are lined up in the predetermined direction and which is lined up in a movement direction intersecting the predetermined direction with respect to the first nozzle row, and a medium in one direction of the movement direction and a moving operation of relatively moving the relative positions of the first and second nozzle rows and the medium in one direction of the predetermined direction, and a second image formation method of repeatedly performing an operation of ejecting fluid from the nozzles while relatively moving the relative positions of the first and second nozzle rows and the medium in both directions of the movement direction and the moving operation to form an image on the medium by the set method, wherein the first image formation method is set when formation of a main image with the first fluid by a nozzle group of a part of the first nozzle row and formation of a background image with the second fluid by a nozzle group of a part of the second nozzle row are performed to overlap the main image and the background image with each other on the medium, in a case where one of the nozzle group of the part of the first nozzle row and the nozzle group of the part of the second nozzle row is positioned closer to the other direction side of the predetermined direction than the other nozzle group to perform the image formation on a predetermined area of the medium in advance of the other nozzle group.

According to the fluid ejecting method, oozing of the image or mixed colors can be suppressed.

Printing System

Hereinafter, a printing system in which an ink jet printer (hereinafter, referred to as a printer) is connected to a computer is exemplified for the description of exemplary embodiments.

Figure 2:
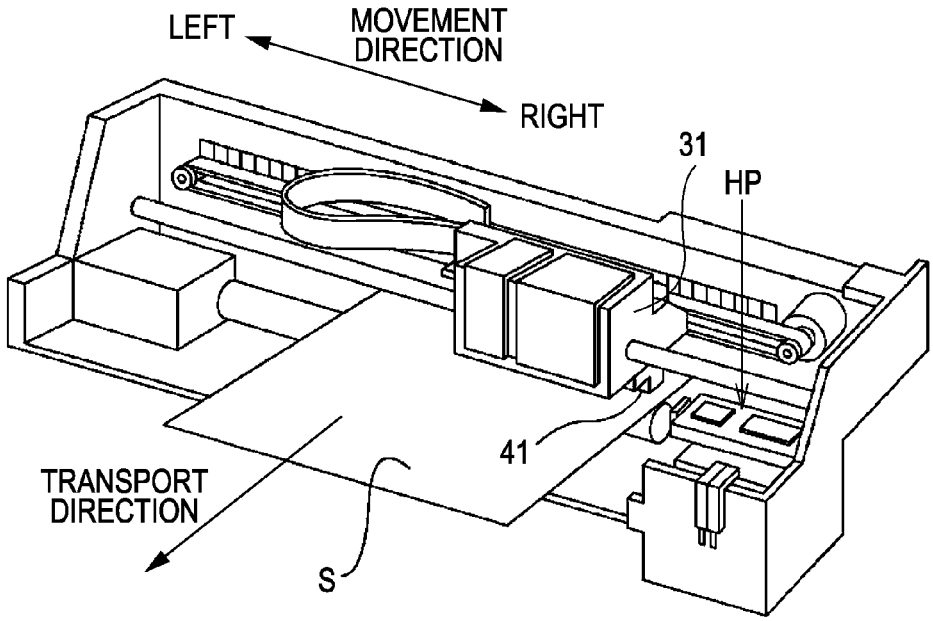
FIG. 2 is a perspective view of the printer.

FIG. 1 is a block diagram of the entire configuration of a printer 1. FIG. 2 is a perspective view of the printer 1. A computer 60 is connected to the printer 1 to communicate therewith and outputs print data to be used for printing an image by the printer 1 to the printer 1. In addition, installed in the computer 60 is a program (printer driver) for converting image data output from an application program into the print data. The printer driver may be recorded on a recording medium (a recording medium that the computer can read out) such as a CD-ROM or downloaded by the computer via the Internet.

A controller 10 is a control unit for controlling the printer 1. An interface unit 11 is used for receiving and transmitting data between the computer 60 and the printer 1. The CPU 12 is an arithmetic processing unit for controlling the entire printer 1. A memory 13 is used for providing an area for storing the programs of the CPU 12 and a work area. The CPU 12 controls each unit by a unit control circuit 14. In addition, a detector group 50 monitors the status in the printer 1, and the controller 10 controls each unit on the basis of the detection result.

A transporting unit 20 sends a medium S to a position where printing can be performed and transports the medium S by a predetermined transport amount in a transport direction (predetermined direction) during the printing.

A carriage unit 30 is used for moving a head 41 in a movement direction intersecting the transport direction (the predetermined direction) and includes a carriage 31.

The head unit 40 is used for ejecting ink onto the medium S and includes the head 41. The head 41 is moved in the movement direction by the carriage 31. Provided on a lower surface of the head 41 is a plurality or nozzles which are ink ejecting portions, and each nozzle is provided with an ink chamber (not shown) containing ink.

Figure 3:
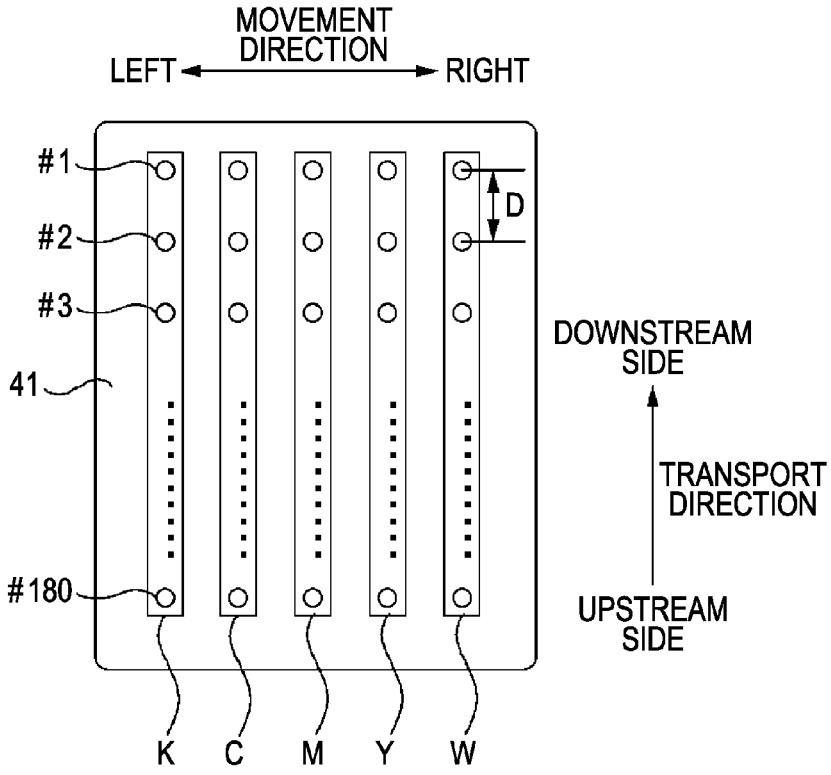
FIG. 3 is a diagram illustrating an array of nozzles provided on a lower surface of a head.

FIG. 3 is a diagram illustrating an array of the nozzles provided on the lower surface of the head 41. In addition, the diagram illustrates the nozzles virtually from an upper surface of the head 41. Formed on the lower surface of the head 41 are 5 nozzle rows each in which 180 nozzles are arrayed in the transport direction at a predetermined interval (a nozzle pitch d). As illustrated in FIG. 3, a black nozzle row K for ejecting black ink, a cyan nozzle row C for ejecting cyan ink, a magenta nozzle row M for ejecting magenta ink, a yellow nozzle row Y for ejecting yellow ink, and a white nozzle W for ejecting white ink are arrayed along the movement direction. Moreover, the 180 nozzles of each nozzle row are assigned with numbers in ascending order from a downstream side of the transport direction (#1 to #180).

In the printer 1, a dot formation process for forming dots on the medium by intermittently ejecting ink droplets from the head 41 which moves along the movement direction and a transportation process (corresponding to a movement operation) for transporting the medium in the transport direction with respect to the head 41 are repeatedly performed. Accordingly, dots may be formed by the subsequent dot formation process at a different position on the medium from a position at which dots are formed by the preceding dot formation process (hereinafter, referred to as a pass), thereby printing a 2D image on the medium.

Print Mode

Figure 4:
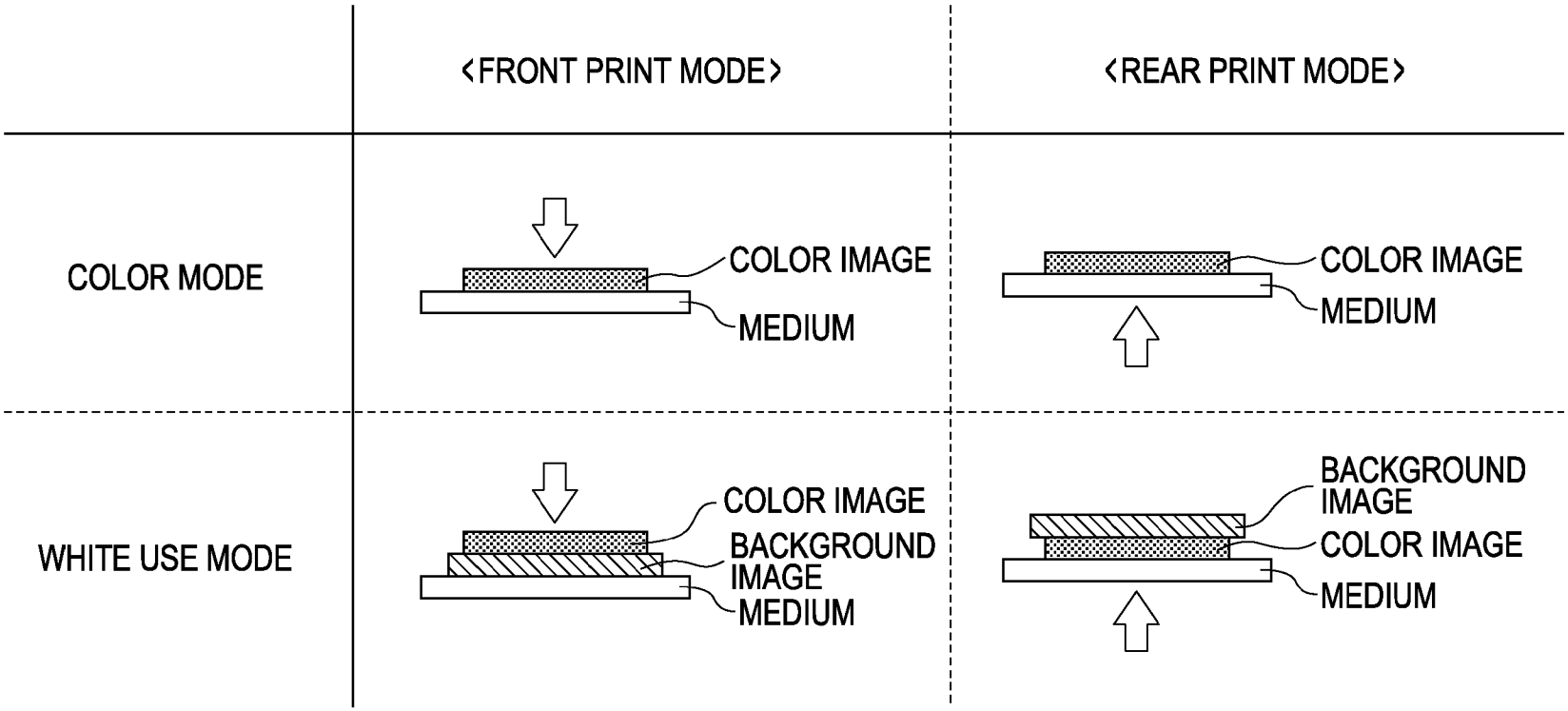
FIG. 4 is a diagram for explaining print modes of the printer.

FIG. 4 is a diagram for explaining print modes of the printer 1 according to this embodiment. The printer 1 forms an image on the medium in one of certain modes including a "color mode" for printing only a color image (including a monochrome image) to be printed with 4-color ink (YMCK) on the medium, and a "white use mode" for printing a background image with white ink and a color image (corresponding to a main image) to be overlapped on the medium. By providing the white background image as a background of the color image in the white use mode, an image with good color developing property can be printed, particularly when the medium is not white. In addition, when the medium is transparent, by printing the color image and the background image to be overlapped, it is possible to prevent the reverse side of the printed matter from becoming transparent.

Moreover, the printer 1 forms an image on the medium in one of certain modes including a "front print mode" for printing a color image to be seen from a printed surface side and a "rear print mode" for printing the color image to be seen from the medium side. That is, the printer 1 includes, as illustrated in FIG. 4, four print modes including a front print and color mode, a rear print and color mode, a front print and white use mode, and a rear print and white use mode.

Printing in White Use Mode and Color Mode

In order to print only the color image on the medium in the color mode, the color image is directly printed on the medium in any of the front print mode and the rear print mode. In the white use mode, in order to print the color image and the background image to be overlapped, in the front print mode the background image is printed on a predetermined area of the medium in advance, and the color image is printed on the background image. On the contrary, in the rear print mode, the color image is printed on the predetermined area of the medium in advance, and the background image is printed on the color image.

Printing in White Use Mode

Figure 5:
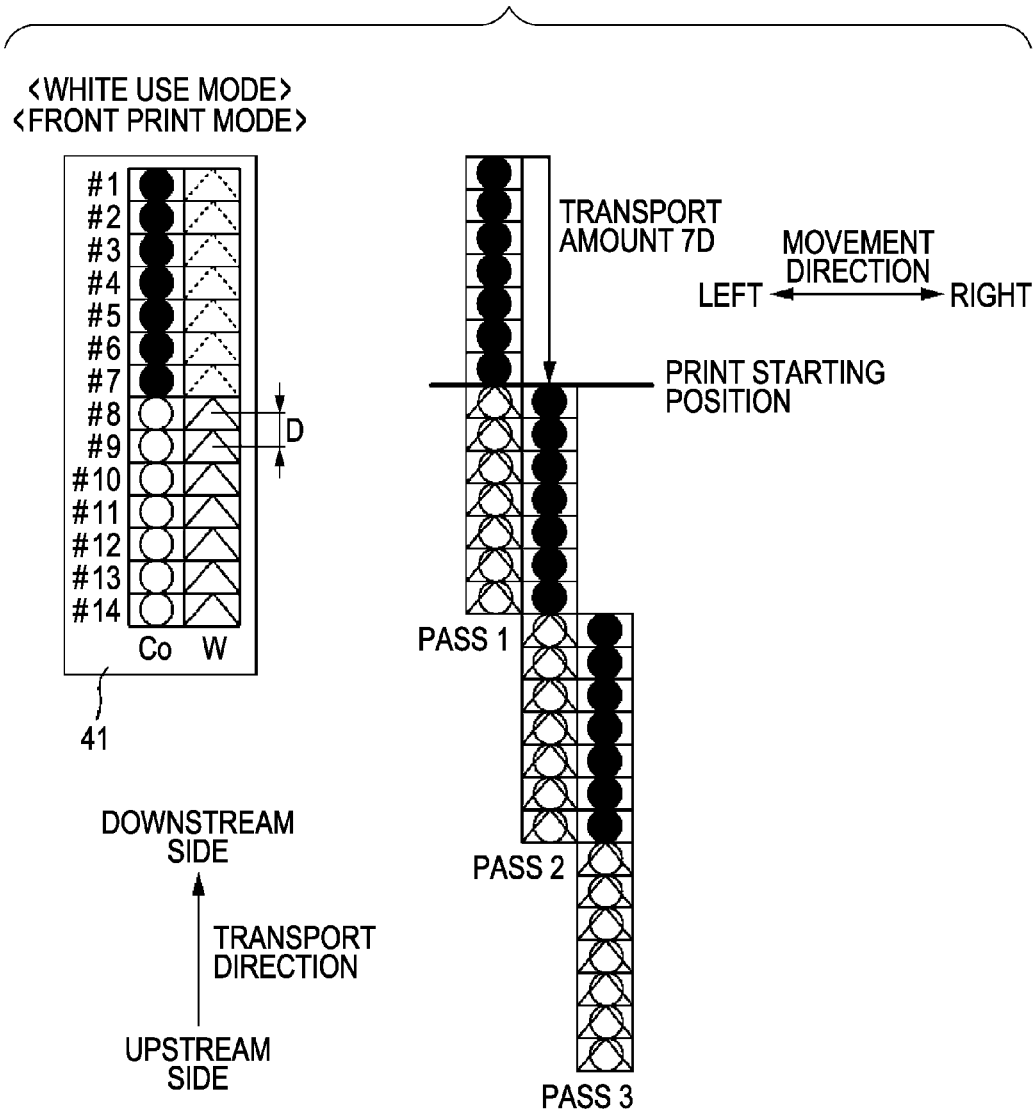
FIG. 5 is a diagram illustrating a printed example in a front print and white use mode.
Figure 6:
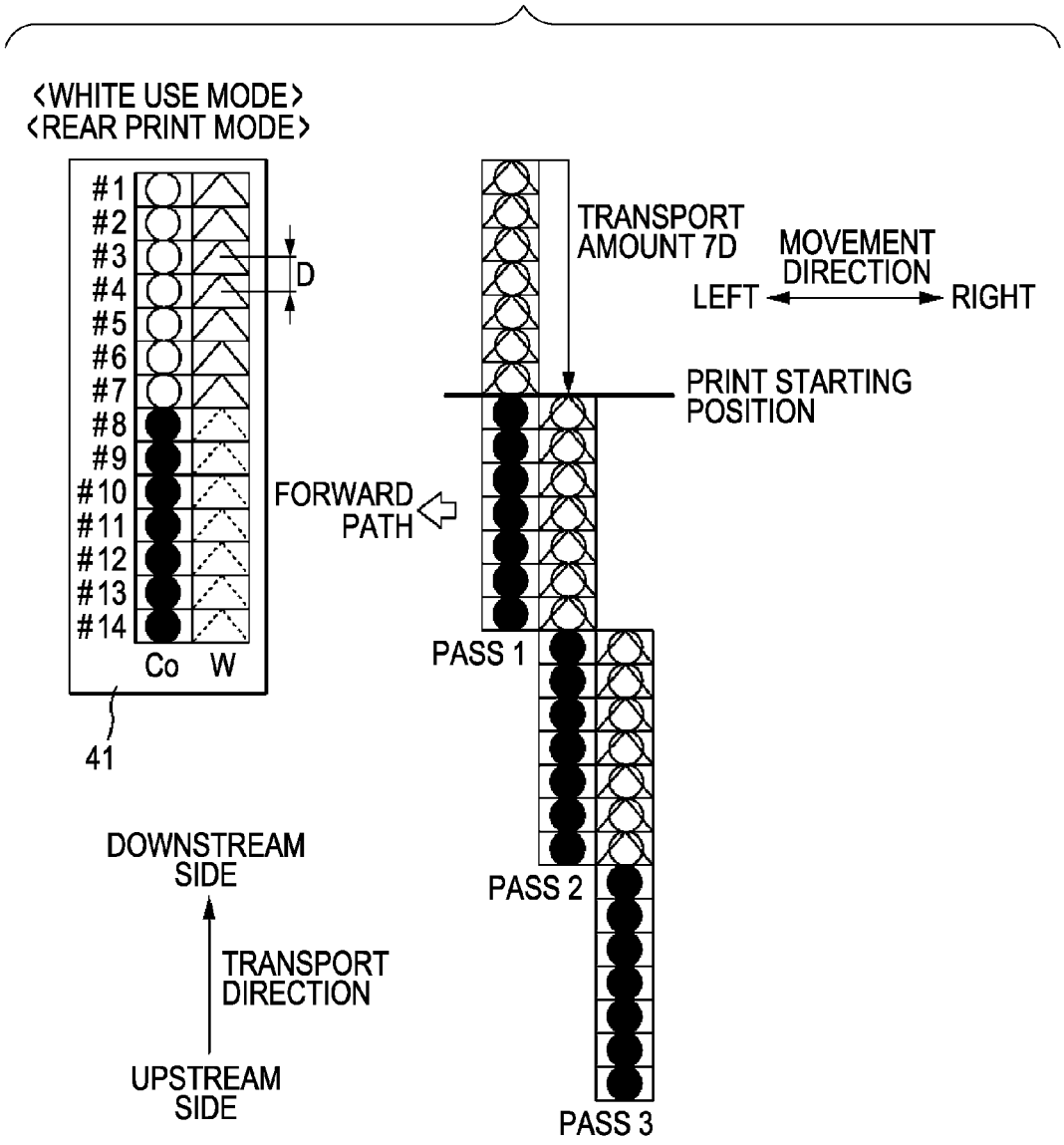
FIG. 6 is a diagram illustrating a printed example in a rear print and white use mode.

FIG. 5 is a diagram illustrating a printed example in the front print and white use mode. FIG. 6 is a diagram illustrating a printed example in the rear print and white use mode. For the simplification of the description, in the figures, the number of nozzles that belong to one nozzle row is reduced to 14. In addition, the nozzle rows respectively ejecting four color inks (YMCK) are collectively referred to as a "color nozzle row Co (corresponding to the first nozzle row)". FIGS. 5 and 6 illustrate band printing. Band printing is a printing method in which band images formed in one pass are lined up in the transport direction and a raster line is not formed in another pass inside a raster line (a dot row along the movement direction) formed in any pass.

However, when the background image is printed using only the white ink, the color itself of the white ink used for printing the background image becomes the color of the background image. However, inks called white inks at the same time may exhibit slightly different tones of white color due to materials of the ink or the like. Therefore, there may be a case where a background image with a color that a user does not want may be printed due to the white ink being used. In addition, depending on the printed matter, there may be a case where a background with a slightly chromatic color is desired instead of a simply white color. When a white medium is used, white media also exhibit different tones of white color depending on types of the media. Accordingly, when a background is printed on a white medium, if the white color of the background image is different from the white color of the medium, the background image becomes noticeable.

Therefore, in this embodiment, a background image (a background image with adjusted white color) with the desired white color is printed appropriately using a small amount of color ink (YMCK) as well as the white ink. That is, when the background image is to be printed, at least one from among the color inks that can be ejected by the printer 1 may be used. For example, four color inks may be used, or two color inks may be used. As described above, as the background is printed using the white ink and the color ink, in a case where the white ink has light color, the background image is printed with ink for cancelling out the color, thereby allowing the background image to approximate an achromatic color.

In addition, print data used for printing the background image with the desired white color by the printer 1 may be stored in the printer 1 in advance or may be prepared by a printer driver. When the desired color of the background image is selected by the user through a monitor of the printer 1 or a screen of the computer, print data of the background image corresponding to the selected color may be generated.

In the front print and white use mode of FIG. 5, the background image is first printed on the predetermined area of the medium, and the color image is printed thereon. Therefore, half (corresponding to a nozzle group of #8Δ to #14Δ) of the nozzles in the white nozzle row W (corresponding to the second nozzle row) on an upstream side of the transport direction (corresponding to the other direction side of the predetermined direction) and half (#8O to #14O) of the nozzles in the color nozzle row Co on the upstream side of the transport direction serve as use nozzles for printing the background image, and half (corresponding to a nozzle group of #1• to #7•) of the nozzles in the color nozzle row Co on the downstream side of the transport direction serve as use nozzles for printing the color image. In addition, in the front print and white use mode, ink is not ejected from half of the nozzles (#1 to #7) in the white nozzle row W on the downstream side of the transport direction. In addition, since FIG. 5 illustrates band printing, an amount of the medium transported once corresponds to a width in the transport direction of the image formed in one pass. In the white use mode, since two types of images are formed in one pass, an amount of the medium transported once corresponds to a width in the transport direction of the background image or the color image formed in one pass. Therefore, in FIG. 5, the amount of the medium transported once is a length "7D" of the half of the nozzle row (the total length of the seven nozzles).

That is, in the front print and white use mode, an operation of forming images using the use nozzles in the white nozzle row W on the upstream side of the transport direction, the use nozzles in the color nozzle row Co on the upstream side of the transport direction, and the use nozzles in the color nozzle row Co on the downstream side of the transport direction, and an operation of transporting the medium by only the transport amount 7D are repeatedly performed. As a result, the predetermined area of the medium is opposed to the use nozzles (#8 to #14) in the white nozzle row W and the color nozzle row Co on the upstream side of the transport direction, and the background image is printed on the predetermined area of the medium. Thereafter, as the medium is transported to the downstream side of the transport direction, the predetermined area of the medium is opposed to the use nozzles (#1 to #7) in the color nozzle row Co on the downstream side of the transport direction, and the color image is printed on the background image in the predetermined area of the medium.

On the contrary, in the rear print and white use mode, as illustrated in FIG. 6, half (#1Δ to #7Δ) of the nozzles in the white nozzle row W on the downstream side of the transport direction, half (#1O to #7O) of the nozzles in the color nozzle row Co on the downstream side of the transport direction serve as use nozzles for printing the background image, and half (#8• to #14•) of the nozzles in the color nozzle row Co on the upstream side of the transport direction serve as use nozzles for printing the color image. In addition, the amount of the medium transported once is the length 7D of half of the nozzle row. As a result, the predetermined area of the medium is first opposed to the use nozzles (#8 to #14) in the color nozzle row Co on the upstream side of the transport direction, and the color image is printed on the predetermined area of the medium. Thereafter, as the medium is transported to the downstream side of the transport direction, the predetermined area of the medium is opposed to the use nozzles (#1 to #7) in the white nozzle row W and the color nozzle row Co on the downstream side of the transport direction, and the background image is printed on the color image in the predetermined area of the medium.

As described above, a position in the transport direction of the nozzles (Δ) in the white nozzle row W for printing the background image and a position in the transport direction of the nozzles (O) in the color nozzle row Co for printing the same background image can be made to be the same. Then, in order to print the background image, white ink and color ink are ejected onto the predetermined area of the medium in the same pass. Consequently, the white ink and the color ink are mixed with each other, thereby reducing granularity of the background image.

The proportion of color ink used for constituting the background image is smaller than the proportion of white ink. Here, in order to reduce the granularity of the color ink in the background image, dots of the color ink may be dispersed as uniformly as possible. That is, a color ink density (dot density) per unit area of the background image is smaller than a white ink density (dot density) per unit area of the background image. Therefore, although the proportion of the color ink used for constituting the background image is smaller than the proportion of the white ink, in this embodiment, the number of nozzles in the white nozzle row W and the number nozzles in the color nozzle row Co, which are used for printing the background image, are equal to each other. That is, the background image is printed using the half of the nozzles that belong to the color nozzle row Co. However, the invention is not limited thereto, and the background image may be printed using nozzles at intervals from among the half of the nozzles in the color nozzle row Co that can be used for printing the background image.

In the white use mode as described above, the use nozzles for the image to be printed first from among the color image and the background image, may be set as the nozzles which are on the upstream side of the transport direction from the use nozzles for the image to be printed subsequently. Accordingly, the images may be printed in the order corresponding to the front print or the rear print mode. In addition, a pass in which the background image is printed on the predetermined area of the medium may be set to be different from a pass in which the color image is printed. In this case, a relatively long time to dry until the subsequent image is printed after the preceding image is printed can be acquired, thereby suppressing oozing of the image.

Printing in Color Mode

On the other hand, in the color mode, only the color image is printed on the medium in both the front print mode and the rear print mode. Accordingly, the entire nozzles that belong to the color nozzle row Co can be used. As the entire nozzles that belong to the color nozzle row Co are used in the color mode (not shown), an image width that can be formed in one pass can be increased, thereby reducing printing time.

In addition, in the color mode, as in the white use mode, only half of the nozzles in the color nozzle row Co may be used (not shown). For example, color nozzles used in the front print and color mode can be made to be the same as color nozzles used in the front print and white use mode (the nozzles on the downstream side of the transport direction), and color nozzles used in the rear print and color mode can be made to be the same as color nozzles used in the rear print and white use mode (the nozzles on the upstream side of the transport direction). In this case, an optimal print pattern and transport control on the medium can be shared by the front print and color mode and the front print and white use mode, and an optimal print pattern and transport control on the medium can be shared by the rear print and color mode and the rear print and white use mode. Accordingly, in the manufacturing process of the printer 1, a process of determining an optimal print pattern depending on (the number or the position of) color nozzles being used can be simplified. Moreover, the manufacturing process includes at least any one of a design process and a mass production process such that in the mass production process the optimal print pattern is determined depending on differences between image quality characteristics of individual printers 1 and in the design process the optimal print pattern is determined depending on the differences between the image quality characteristics of the types of the printers 1. Therefore, a memory capacity for storing the optimal print pattern for each mode and information on the transport control on the medium can be reduced. In addition, test printing is performed in the color mode before actually performing printing in the white use mode to check image quality of the color image, so that an amount of the white ink consumed can be suppressed.

Settings of Unidirectional Printing and Bidirectional Printing

Figure 7A:
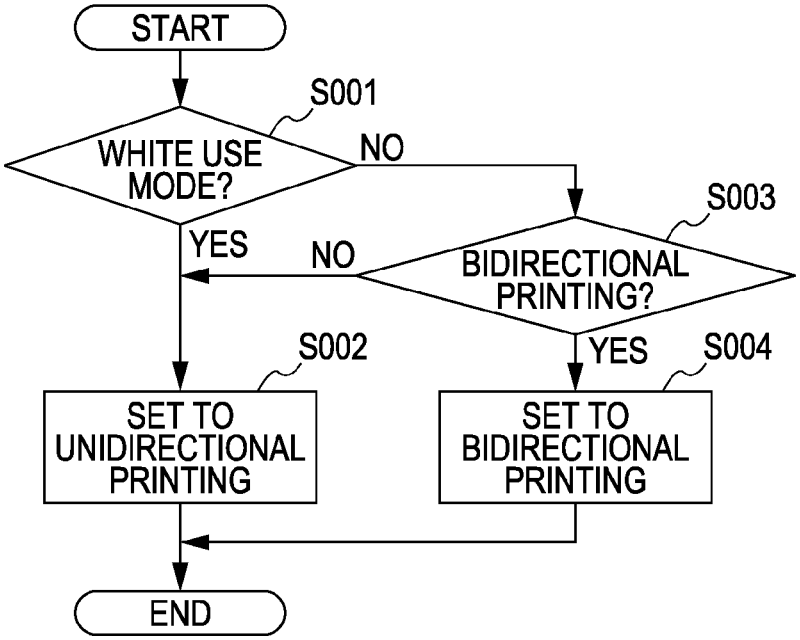
FIG. 7A is a diagram showing a setting flow of unidirectional printing and bidirectional printing.
Figure 7B:
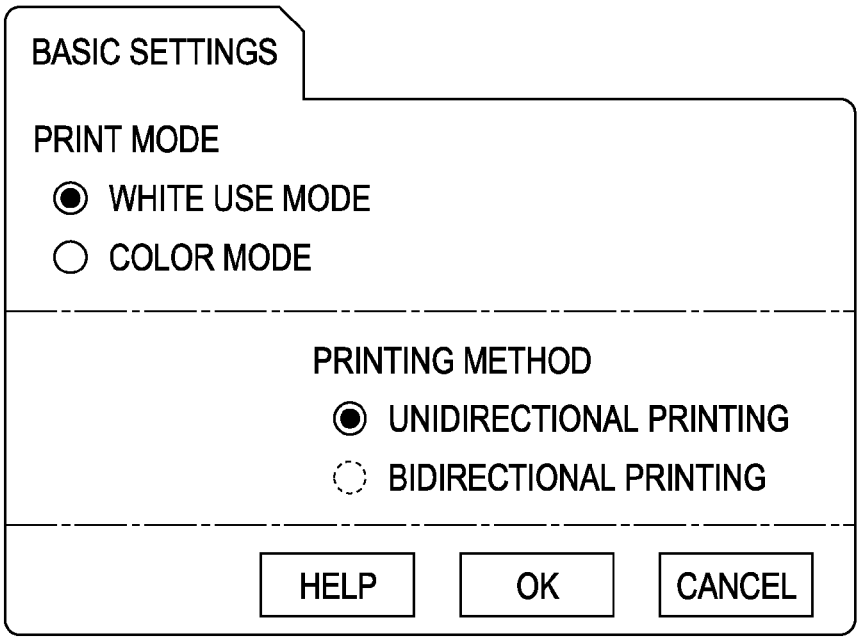
FIG. 7B is a diagram illustrating a window displayed for a user.

FIG. 7A is a diagram showing a setting flow of unidirectional printing and bidirectional printing, and FIG. 7B is a diagram illustrating a window displayed for a user. In the printer 1 according to this embodiment, as illustrated in FIG. 2, a home position HP of the head 41 is on the right of the movement direction. In addition, the printer 1 may select any printing method from "unidirectional printing (first image formation method)" in which ink droplets are ejected from the nozzles during a forward path when the head 41 moves from the right (from the home position) to the left of the movement direction and ink droplets are not ejected from the nozzles during a return path when the head 41 moves from the left to the right of the movement direction, and "bidirectional printing (second image formation method)" in which ink droplets are ejected from the nozzles during both the forward path and the return path, to perform printing. Moreover, with regard to the unidirectional printing, ink droplets may not be ejected from the nozzles during the forward path while ink droplets are ejected from the nozzles during the return path.

In the following description, here, an operation of moving the head 41 once in the movement direction while ejecting ink droplets is referred to as a "pass (corresponding to an ejecting operation)". That is, in the unidirectional printing, an operation during the forward path corresponds to one pass, and in the bidirectional printing, each of an operation during the forward path and an operation during the return path corresponds to one pass. In addition, an operation of moving the head 41 in the movement direction while not ejecting ink droplets during the return path of the unidirectional printing is referred to as a "returning operation".

In the unidirectional printing, after an image is printed on the medium in any pass during the forward path, the medium is transported to the downstream side of the transport direction. In addition, after the head 41 is returned to the home position by the returning operation, the image is printed on the medium again in the pass during the subsequent forward path. Moreover, in the printer 1 according to this embodiment, the transport operation of the medium and the returning operation of the head 41 are not simultaneously performed. Therefore, in the unidirectional printing, a time after the image is formed in any pass (forward path) and until the image is formed in the subsequent pass (forward path) is the sum of a time taken to transport the medium in the transport direction and a time taken to perform the returning operation of the head 41. Moreover, any of the transport operation of transporting the medium in the transport direction and the returning operation of the head 41 may be performed in advance.

On the other hand, in the bidirectional printing, after the image is printed on the medium in any pass during the forward path, the medium is transported on the downstream side of the transport direction. In addition, the image is printed on the medium again in the subsequent pass during the return path. Therefore, in the bidirectional printing, a time after the image is formed in any pass (forward path) and until the image is formed in the subsequent pass (return path) is a time taken to transport the medium in the transport direction. That is, in the case where a printing method is performed in the unidirectional printing, a time interval between passes to form the image is lengthened by an amount of the time taken to perform the returning operation, compared to the case where the printing method having the same medium transport amount (transport time) is performed in the bidirectional printing. In other words, a time after the operation of forming an image in any pass is completed and until the operation of forming the image in the subsequent pass is started in the unidirectional printing is longer than that in the bidirectional printing. Moreover, the operation of forming the image in each path is an operation, after acceleration of the head 41 is started, of ejecting ink during the movement of the head 41 until the head 41 is decelerated and stopped, and ink is not always ejected during the operation of forming the image.

However, the printer 1 prints the background image and the color image to be overlapped in the white use mode as illustrated in FIG. 4. As illustrated in FIGS. 5 and 6, as the use nozzles of the image from among the background image and the color image which is printed in advance are set to nozzles on the upstream side of the transport direction from the use nozzles of the image printed subsequently, the pass in which the background image is printed on the predetermined area of the medium and the pass in which the color image is printed can be set to be different from each other. Moreover, in this embodiment, in the white use mode, non-use nozzles are not provided between the use nozzles in the color nozzle row Co (for example, the nozzles #1 to #7 in FIG. 5) and the use nozzles in the white nozzle row W (for example, the nozzles #8 to #14 in FIG. 5). Therefore, printing the subsequent image is started in the pass subsequent to the pass in which printing the preceding image on the predetermined area of the medium is terminated.

Here, if the bidirectional printing is performed in the white use mode, after the background image is printed on the predetermined area of the medium in any pass during the forward path and the medium is transported to the downstream side, the color image is printed in the subsequent pass during the return path. In this case, for example, a time after printing the background image on the predetermined area of the medium is terminated and until printing the color image is started, that is, a drying time of the background image is only the transport time of the medium. Therefore, as the bidirectional printing is performed in the white use mode, the drying time of the background image which is printed in advance is short and the image may ooze. Particularly, in the white use mode, in order to set the pass in which the background image is printed and the pass in which the color image is printed to be different from each other, the length of the nozzles used for printing each image is set to be the length of the half of each of the nozzle rows W and Co. Therefore, in the white use mode, a time taken to transport the medium is relatively short, and the drying time of the image printed in advance is short, so that the image is more likely to ooze. In addition, when printing is actually performed by the user, printing with higher resolution in the transport direction than that of the band printing illustrated in FIG. 5 or 6 tends to be performed. Then, the medium transport amount is further reduced in the white use mode, so that the drying time of the image printed in advance is reduced.

Here, according to this embodiment, when the white use mode is selected, the printer 1 performs the unidirectional printing other than the bidirectional printing. As the unidirectional printing is performed in the white use mode, the time after printing the preceding image on the predetermined area of the medium is terminated and until printing the subsequent image is started, that is, the drying time of the preceding image is the sum of the time taken to transport the medium and the time taken to perform the returning operation of the head 41. That is, as the unidirectional printing is performed in the white use mode, the drying time of the preceding image is lengthened by the time to perform the returning operation of the head 41, thereby printing the image with high image quality while oozing of the image is suppressed.

Accordingly, in this embodiment, the printer driver, when it receives a print command from the user, allows a display of the computer 60 to display a window illustrated in FIG. 7B to allow the user to select one of the print modes including the "white use mode" and the "color mode". Then, when the white use mode is selected by the user (Yes in S001 of FIG. 7A), the printer driver sets the printing method of the "unidirectional printing" (S002). Here, as shown by the window of FIG. 7B, the user cannot select the "bidirectional printing".

On the other hand, when the color mode is selected by the user (No in S001), the printer driver allows the user to select one of the printing methods including the "unidirectional printing" and the "bidirectional printing". Here, on the window of FIG. 7B, the user is allowed to select on from the "unidirectional printing" and the "bidirectional printing". In addition, when the bidirectional printing is selected by the user (Yes in S003), the printer driver sets the printing method to the "bidirectional printing" (S004). When the unidirectional printing is selected by the user (No in S003), the printer driver sets the printing method to the "unidirectional printing" (S002).

Thereafter, the printer driver generates print data in response to the print mode and transmits command data on the printing method (whether to print in the unidirectional printing or in the bidirectional printing) along with the generated print data to the printer 1. The controller 10 of the printer 1 sets the printing method to one of the unidirectional printing and the bidirectional printing on the basis of the command data from the printer driver. When the unidirectional printing is set, the controller 10 controls each unit on the basis of the print data so that ink droplets are ejected from the head 41 during the forward path and ink droplets are not ejected from the head 41 during the return path. When the bidirectional printing is set, the controller 10 controls each unit on the basis of the print data so that ink droplets are ejected from the head 41 during both the forward path and the return path.

As a result, since the unidirectional printing is performed in the white use mode, it is possible to devote the sum of the transport time of the medium and the return time of the head 41 to the drying time of the background image and the color image, thereby printing the image with high image quality while oozing of the image is suppressed. On the other hand, in the color mode, the image is printed by the printing method selected by the user from the unidirectional printing and the bidirectional printing. In the color mode, since only the color image is printed on the medium, there is no concern of oozing of the image even when the bidirectional printing is performed, so that there is no problem.

However, when printing is performed in the white use mode according to this embodiment, as illustrated in FIGS. 5 and 6, the nozzles for the image which is formed on the predetermined area of the medium in advance from among the background image and the color image are set to the nozzles on the upstream side of the transport direction from the nozzles for the image to be formed subsequently. However, even in the case the entire nozzles in the white nozzle row W and the entire nozzles in the color nozzle row Co are used, the background image and the color image can be printed to be overlapped. Here, in this case, since the background image and the color image are printed to be overlapped in the same pass, the drying time of the image printed in advance cannot be increased even when the unidirectional printing is performed. That is, as in this embodiment, the nozzle group positioned on the upstream side of the transport direction from among a part of the nozzle group of the white nozzle row W and a part of the nozzle group of the color nozzle row Co forms the image in advance on the predetermined area of the medium, such that the pass in which the background image is printed is different from the pass in which the color image is printed. Therefore, by performing the unidirectional printing, the drying time of the image to be printed in advance can be increased.

Moreover, in the embodiment described above, after the color mode is selected, the user is allowed to select one from the unidirectional printing and the bidirectional printing by the window of FIG. 7B; however, the invention is not limited thereto. The bidirectional printing can reduce the printing time compared to the unidirectional printing. Accordingly, in the color mode, two images are not printed to be overlapped, and there is no concern of oozing of the two images, so that the bidirectional printing may be set when the color mode is selected, thereby reducing the printing time. However, in the bidirectional printing, due to the difference between the forward path and the return path characteristics (for example, a difference between the forward path and the return path in landing position, and the like), there is a case where image quality is degraded compared to the unidirectional printing. Accordingly, for example, in a case where the color mode is selected while one of a "sharp mode" and a "quick mode" is selected as basic setting of the printing, the printer driver may set the printing method to the unidirectional printing when the sharp mode is set and set the printing mode to the bidirectional printing when the quick mode is set.

Accordingly, in the case where the printer driver sets the printing method to the unidirectional printing or the bidirectional printing according to the print mode (the white use mode or the color mode) and printing is controlled by the controller 10 of the printer 1 depending on the set printing method, the computer 60 in which the printer driver is installed and the controller 10 of the printer 1 correspond to the control unit, and the printing system in which the printer 1 is connected to the computer 60 corresponds to the fluid ejecting apparatus.

Here, the invention is not limited thereto, and the printer driver may allow the user to select one from the white use mode and the color mode and transmit information on the print mode to the printer 1. In addition, the controller 10 of the printer 1 sets the printing method to the unidirectional on the basis of the print mode information transmitted from the printer driver when the white use mode is selected and controls the printing as the unidirectional printing. When the print mode information transmitted from the printer driver indicates the color mode, the controller 10 of the printer 1 may display the window of FIG. 7B to allow the user to select one from the unidirectional printing and the bidirectional printing and control the printing in the selected printing method. In this case, the controller 10 of the printer 1 corresponds to the control unit, and the printer 1 itself corresponds to the fluid ejecting apparatus.

In addition, in the flow of FIG. 7A, only the unidirectional printing can be set when the white use mode is selected; however, the invention is not limited thereto. When the white use mode is selected, the unidirectional printing may be set as a recommended printing method (as a default). In addition, even in the white use mode, the user may be allowed to select the bidirectional printing on the setting screen (FIG. 7B). Thus, when the user wants quick printing (for example, in trial printing or the like), the bidirectional printing can be performed even in the white use mode.

However, even though the bidirectional printing is performed in the white use mode, the medium is transported by forming the image in any pass of the forward path, a downtime is provided, and then the image is formed in the subsequent pass of the return path, thereby ensuring the drying time of the image printed in advance. As a result, oozing of the image can be suppressed. However, if a downtime is provided between the forward path and the return path in the bidirectional printing of the white use mode while a downtime is not provided between the forward path and the return path in the bidirectional printing of the color mode, printing control becomes complex. In addition, when the downtime is provided, a program or device for counting a predetermined downtime is needed.

In addition, for example, it is assumed that there is a printer which is provided with a head for ejecting only color inks (YMCK) to perform only the color mode and can perform the bidirectional printing and unidirectional printing. By complementing white ink to the head of the printer, the color mode and the white mode can be performed. However, as described above, if the downtime is provided between the forward path and the return path in the bidirectional printing of the white use mode and the downtime is not provided between the forward path and the return path in the bidirectional printing of the color mode, a new program or control circuit is needed. As a result, the manufacturing cost of the print is increased. Therefore, as in this embodiment, using the bidirectional printing and the unidirectional printing of the printer, the unidirectional printing is set in the white use mode, thereby suppressing oozing of the image without a new program or control circuit.

In addition, as described above, the printer 1 of this embodiment does not simultaneously perform the transport operation of the medium and the returning operation of the head 41. This is because when the transport operation of the medium and the returning operation of the head 41 are simultaneously performed, mechanical vibrations or noises in a driving signal occur and thus transport accuracy is degraded. Otherwise, when the transport operation of the medium and the returning operation of the head 41 are simultaneously performed, control becomes complex. As described above, as the transport operation of the medium and the returning operation of the head 41 are not simultaneously performed, in the white use mode, that is, in the unidirectional printing, the time (the drying time) after printing the preceding image on the predetermined area of the medium is terminated and until printing the subsequent image is started is the sum of the transport time of the medium and the returning time of the head 41 and is thus long, thereby suppressing oozing of the image.

Moreover, in a case where a time taken to perform the returning operation of the head 41 is longer than a time taken to perform the transport operation of the medium, the transport operation of the medium and the returning operation of the head 41 may be simultaneously performed. In this case, in the unidirectional printing the returning time of the head 41 corresponds to the drying time of the background image and the color image, and in the bidirectional printing the transport time of the medium corresponds to the drying time. Therefore, the drying time given when the unidirectional printing is performed can be lengthened compared to the drying time given when the bidirectional printing is performed.

In recent years, the demand for large-size printers has increased. In the large-size printer, a movement distance of the head 41 in the movement direction is long, and the returning time of the head 41 is lengthened. Therefore, in the large-size printer, the drying time of the background image and the color image in the unidirectional printing can further be lengthened, so that oozing of the image can further be suppressed. However, during the formation of the image, a movement speed of the head 41 in the movement direction is subjected to an ink ejection interval from the head 41; however, the movement speed of the head 41 during the returning operation is variable. Accordingly, in the case where the time taken to perform the returning operation of the head 41 (a time during the formation of the image) is longer than a time needed to dry the image, the movement speed of the head 41 during the returning operation may be higher than that during the image formation. On the other hand, the movement speed of the head 41 during the returning operation may be lower than that during the image formation by the time needed to dry the image.

As such, the movement speed of the head 41 during the returning operation with respect to the movement speed of the head 41 during the image formation is variable, and the time needed to perform the returning operation of the head 41 may be equal to or smaller than the image formation time in one pass. Here, in the white use mode according to this embodiment, since the maximum medium transport amount of one transport operation is half of the length of the nozzle row, so that the returning time of the head 41 in the unidirectional printing is longer than the time taken to transport the medium having a length of the half of the nozzle row. Accordingly, even when the transport operation of the medium and the returning operation of the head 41 are simultaneously performed, the drying time in the unidirectional printing corresponds to the returning time of the head 41, and the drying time in the bidirectional printing corresponds to the transport time of the medium, so that the drying time in the unidirectional printing is longer than that in the bidirectional printing. More preferably, the returning time of the head 41 in the unidirectional printing is longer than the time taken to transport the medium having the length of the nozzle row. Accordingly, the unidirectional printing has obviously longer drying time than the bidirectional printing. As a result, the effect of setting the unidirectional printing when the white use mode is selected can be positively obtained.

In the white use mode, the non-use nozzles may be provided between the use nozzles in the color nozzle row Co (for example, the nozzles on the downstream side of the transport direction in the front print mode) and the use nozzles in the white nozzle row W (for example, the nozzles on the upstream side of the transport direction in the front print mode). Accordingly, a pass in which the image is not performed (a pass in which the non-use nozzles opposite to the medium) can be provided at an interval between the pass in which the preceding image is printed on the predetermined area of the medium and the pass in which the subsequent image is printed, thereby lengthening the drying time of the background image and the color image. Even in this case, when the white use mode is selected, the unidirectional printing is set other than the bidirectional printing, thereby lengthening the drying time of the background image and the color image. In addition, the length in the transport direction of an area to which the non-use nozzles belong is an integer multiple of the medium transport amount. Accordingly, for the entire area of the image, the number of passes between the pass in which the preceding image is printed and the pass in which the subsequent image is printed is constant, thereby preventing density unevenness of the image.

Otherwise, in any pass, a printing method of forming, between two raster lines (dot rows along the movement direction) formed in any pass by two nozzles lined up in the medium transport direction in the nozzle row, a raster line in another path, so-called interlace printing may be performed. Otherwise, a printing method of printing a raster line in different passes using a plurality of nozzles, so-called overlap printing may be performed. In such cases, the amount of the medium transported once is shorter than that of the above embodiments (FIGS. 5 and 6). Therefore, when the bidirectional printing is performed during the interface printing or the overlap printing, the drying time of the background image and the color image is further shortened, so that the unidirectional printing may be performed. In addition, in the interface printing or the overlap printing, (in order to perform printing by adjusting the number of nozzles) a pass in which the image is not formed at an interval between the pass in which the preceding image is printed and the pass in which the subsequent image is printed is provided. However, when the white use mode is selected, regardless of printing method, the unidirectional printing may be set. Accordingly, the drying time of the background image and the color image may be lengthened.

MODIFIED EXAMPLES

Figure 8A:
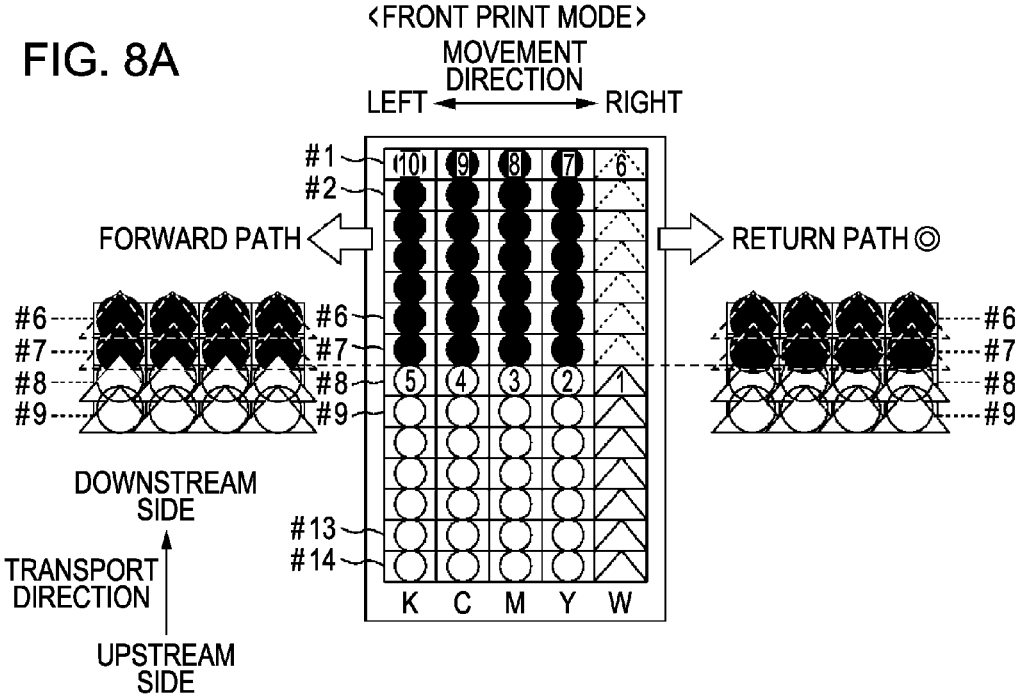
FIGS. 8A and 8B are diagrams for explaining directions of the unidirectional printing suitable for the front print mode and the rear print mode in the white use mode.
Figure 8B:
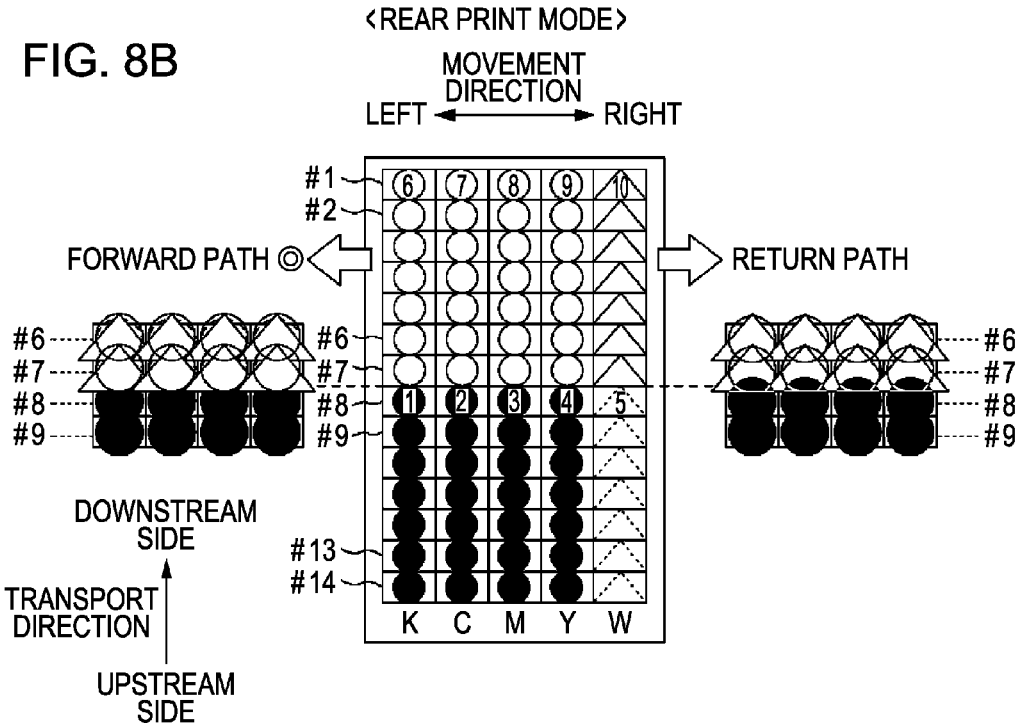

FIGS. 8A and 8B are diagrams for explaining directions of the unidirectional printing suitable for the front print mode and the rear print mode in the white use mode. In the unidirectional printing of the above embodiment, the image is formed during the forward path (during the movement of the head 41 from the home position); however, the invention is not limited thereto. Even in the unidirectional printing, depending on the print mode, the image may be formed during the forward path, or the image may be formed in the return path.

FIG. 8A illustrates printing performed in the front print and white use mode. In the figure, the number of nozzles that belong to a single nozzle row is set to 14, and the center part of the figure illustrates the nozzles used in the front print and white use mode. In the front print and white use mode, the half #8 to #14 of the nozzles in the white nozzle row W on the upstream side of the transport direction and the half #8 to #14 of the nozzles in the color nozzle rows (YMCK) on the upstream side of the transport direction are used for printing the background image, and the half #1 to #7 of the nozzles in the color nozzle row (YMCK) on the downstream side of the transport direction are used for printing the color image. Here, a dot formation method of pixels (pixels to which the nozzles #6 to #9 can be allocated in the figure) corresponding to the boundary line between the use nozzles for white and the use nozzles for color will be described.

First, the pixels on the boundary line during the forward path are focused on (pixels on the left in the figure). Moreover, dots of the background image are already formed in the pixels corresponding to the nozzles #6 and #7. In the printer 1 of this embodiment, from the left (corresponding to a second direction) of the movement direction of the head 41, a black nozzle row K, a cyan nozzle row C, a magenta nozzle row M, a yellow nozzle row Y, and a white nozzle row W are arrayed in this order. Therefore, during the forward path for the movement from the right to the left in the movement direction, first, dots (•) for the color image are formed in the pixels of the nozzles #6 and #7, and thereafter dots (Δ) of white ink which occupies most of the background image are formed in the pixels of the nozzles #8 and #9. Generally, a dot larger than the area of one pixel at the maximum is formed. Particularly, since the background image is formed by solid coating printing of white color, a dot larger than the pixel is formed. Therefore, in the front print mode, while forming the dots for the background image under (in advance of) the dots for the color image is natural in the front print mode, in the pixels (pixels of the nozzles #7 and #8) on the boundary line between the use nozzles for the background image and the use nozzles for the color image, the overlapping order of the dots for the background image and the dots for the color image is reversed. In this case, there is a concern that color tone of only the pixels on the boundary line is different from that of other pixels.

On the other hand, during the return path for the movement from the left to the right in the movement direction, dots (Δ) of the white ink are formed in the pixels of the nozzles #8 and #9, and thereafter dots (•) for the color image are formed in the pixels of the nozzles #6 and #7. Therefore, during the return path, in the pixels on the boundary line between the use nozzles for the background image and the use nozzles for the color image (the pixels of the nozzles #7 and #8), the dots for the background image are formed under (in advance of) the dots for the color image. Accordingly, in the pixels on the boundary line and other pixels, the overlapping order of the dots for the background image and the dots for the color image can be uniform, so that a change in color tone of the pixels on the boundary line can be prevented. That is, when the unidirectional printing is performed in the front print and white use mode, the image may be formed on the return path, and the position of the head 41 may be returned on the forward path.

In addition, numbers are shown inside the nozzles #1 and #8 of FIG. 8A. Moreover, the nozzles #1 and #8 may be allocated to the same pixel. In addition, the numbers inside the nozzles represent the order of the nozzles to which a predetermined pixel is opposed in the case where the image formation operation is performed on the return path and the returning operation of the head 41 is performed on the forward path. In order to form the image on the return path, in the pass of the same return path, first, the use nozzle #8 for white on the upstream side of the transport direction is opposed to a predetermined pixel to form dots, and then the use nozzles #8 of yellow, magenta, cyan, and black are opposed to the predetermined pixel in this order to form dots. Thereafter, the medium is transported to the downstream side, and in the pass of the subsequent return path, first, the non-use nozzle #1 of white on the downstream side of the transport direction is opposed to a predetermined pixel, and then the use nozzle #1 of each color is opposed to the predetermined pixel to form dots.

That is, when the unidirectional printing is performed in the front print (corresponding to a first mode) and white use mode, as the image is formed on the return path (as the image is formed during the movement to the right (in the first direction) of the movement direction), dots of white ink which occupies most of the background image are formed relatively early in the pass in which the background image is formed on the predetermined area of the medium, and dots for the color image are formed relatively late in the pass in which the color image is formed. As a result, the drying time of the white ink can further be lengthened. On the contrary, when the image is formed during the forward path, the predetermined area of the medium is opposed to the use nozzles #8 for white after the use nozzles #8 for color, and thus the use nozzles #1 for color are opposed thereto in advance of the non-use nozzle #1 for white, so that the drying time of the white ink is shortened. For this reason, it can be said that forming the image on the return path is preferable in the case where the unidirectional printing is performed in the front print and white use mode.

FIG. 8B illustrates printing performed in the rear print (corresponding to a second mode) and white use mode. In the rear print and white use mode, the half #1 to #7 of the nozzles in the white nozzle row W on the downstream side of the transport direction, the half #1 to #7 of the nozzles in the color nozzle rows (YMCK) on the downstream side of the transport direction, and the half #8 to #14 of the nozzles in the color nozzle rows (YMCK) on the upstream side of the transport direction are used. In the rear print and white use mode, as the image is formed during the forward path (the image is formed during the movement to the left of the movement direction (in the second direction)), as illustrated in the left pixels in the figure, the dots (•) for the color image are formed in advance of (under) the dots (Δ) of white ink which occupies the most of the background image in the pixels (the pixels of the nozzles #7 and #8) on the boundary line between the use nozzles for the background image and the use nozzles for the color image. On the other hand, as the image is formed during the return path, as illustrated in the right pixels in the figure, the dots of white ink are formed in advance of the dots for color image in the pixels on the boundary line. Since it is natural to form the dots (•) for the color image in advance of the dots (Δ) of white ink in the rear print mode, in the case where the unidirectional printing is performed in the rear print and white use mode, the image may be formed on the forward path, and the position of the head 41 may be return on the return path. As a result, the overlapping order of the dots for the background image and the dots for the color image can be uniform over the entire area of the image, thereby uniformizing color tone.

In addition, numbers inside the nozzles #1 and #8 of FIG. 8B represent the order of the nozzles to which a predetermined pixel is opposed in the case where the image formation operation is performed on the forward path and the returning operation of the head 41 is performed on the return path. When the unidirectional printing is performed in the rear print and white use mode, as the image is formed on the forward path, the dots for the color image are formed relatively early in the pass in which the color image is formed on the predetermined area of the medium, and dots of white ink are formed relatively late in the pass in which the background image is formed thereon. As a result, the drying time after the color image is printed and until a large amount of white ink is ejected can be further lengthened, thereby suppressing oozing of the image. Accordingly, in the case where the unidirectional printing is performed in the rear print and white use mode, forming the image on the forward path is preferable.

Modified Examples of Image

While the background image in which tone of white color is adjusted using the white ink and the color ink has been exemplified, the invention is not limited thereto. A background image printed only using white ink may be allowed. However, in this case, the background image with only the white ink color may be printed. Accordingly, a background image with a desired color cannot be printed, and a difference between the color of the background image and a base color of the medium is noticeable. Therefore, the background image with high quality cannot be printed. Hereinafter, a printed example in the case where the background image is printed with only the white ink will be described.

Figure 9:
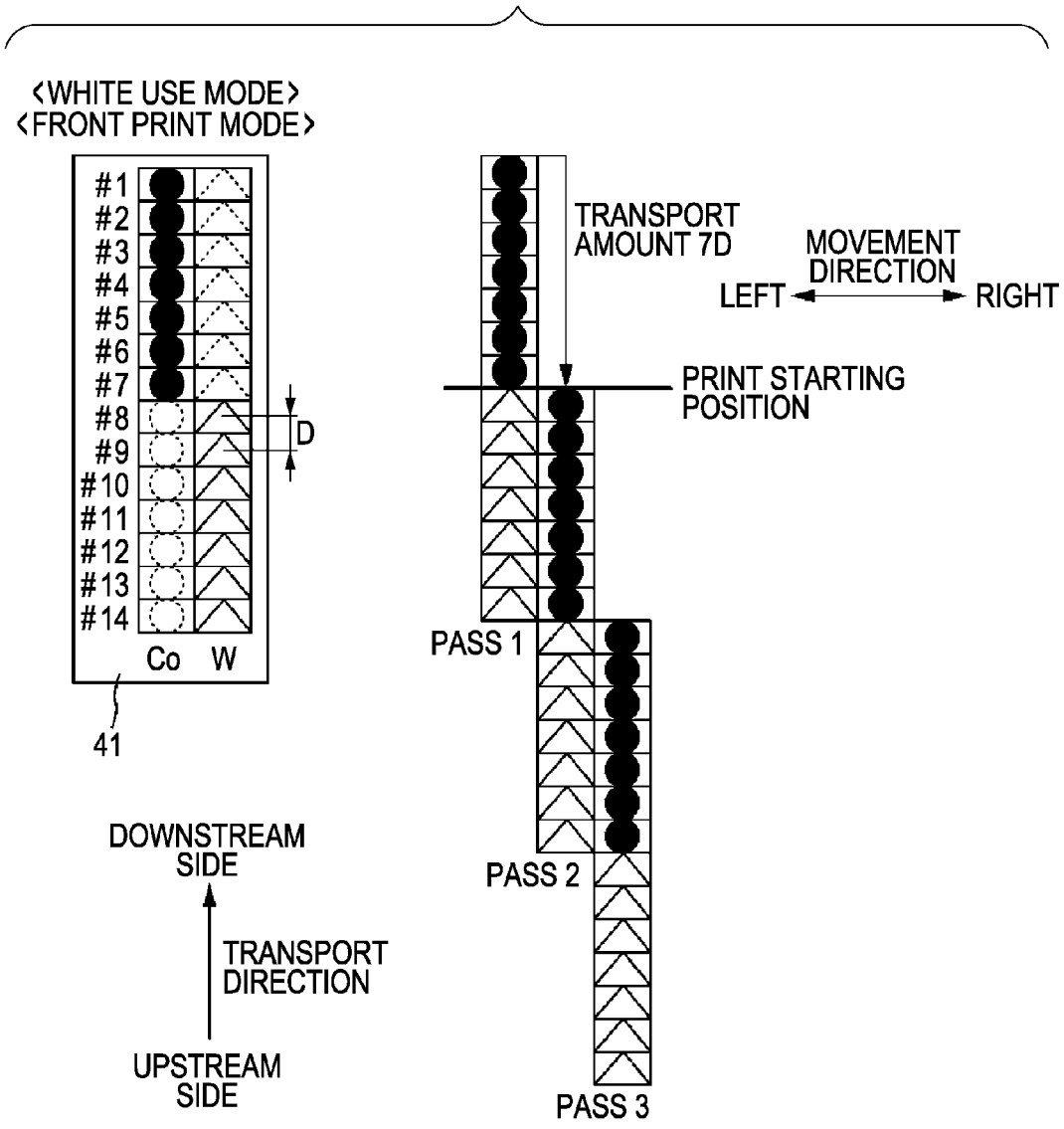
FIG. 9 is a diagram illustrating a printed example of the front print and white use mode.
Figure 10:
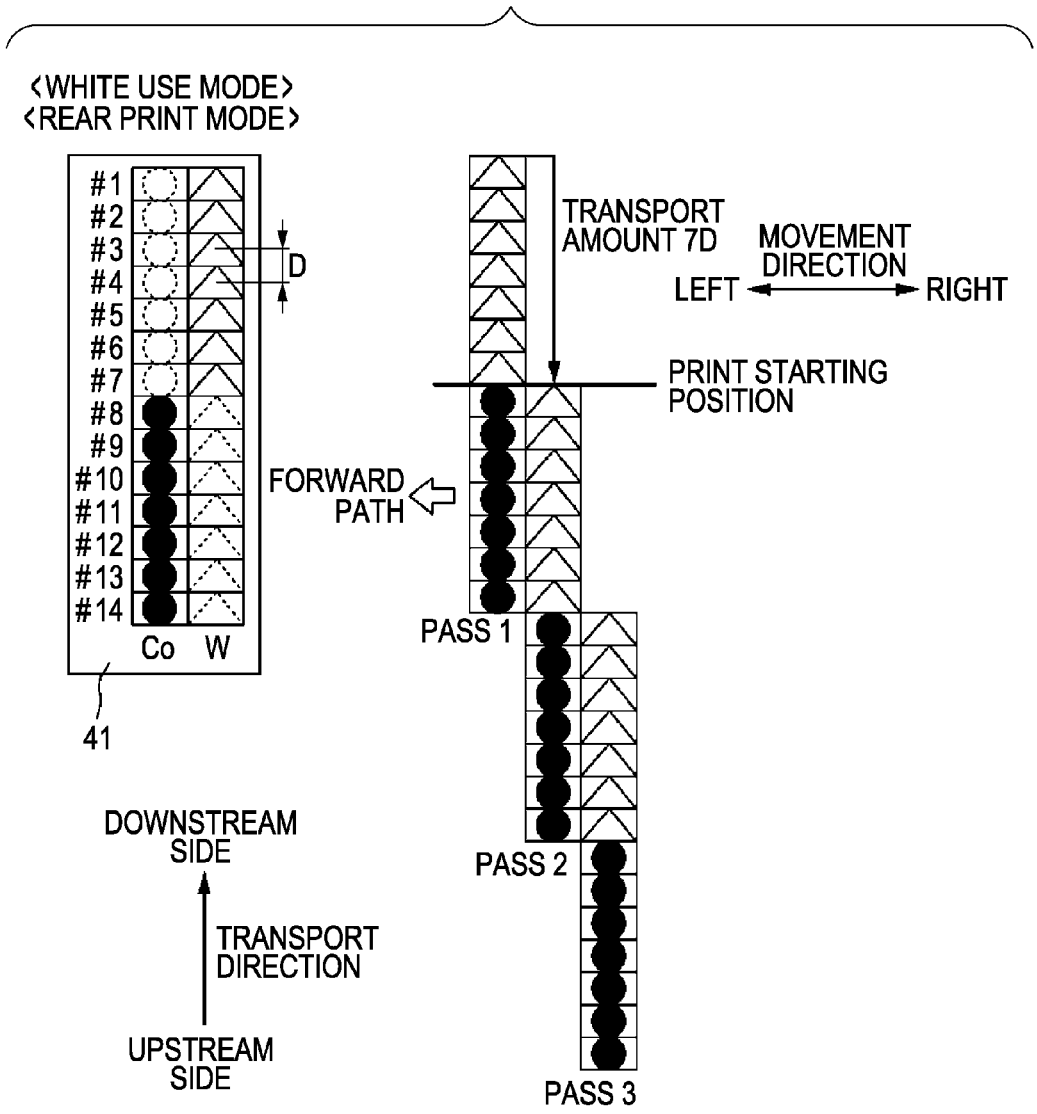
FIG. 10 is a diagram illustrating a printed example of the rear print and white use mode.

FIG. 9 is a diagram illustrating a printed example in the front print and white use mode. FIG. 10 is a diagram illustrating a printed example in the rear print and white use mode. In the figures, for the simplification of the description, the number of nozzles that belong to a single nozzle row is reduced to 14. In addition, the nozzle rows for ejecting four color inks (YMCK) are collectively referred to as a "color nozzle row Co (corresponding to a first nozzle row)". FIGS. 9 and 10 illustrate band printing. The band printing is a printing method in which band images formed in one pass are lined up in the transport direction and a raster line is not formed in another pass inside a raster line (a dot row along the movement direction) formed in any pass.

In the front print and white use mode of FIG. 9, a background image is printed on a predetermined area of a medium in advance, and a color image is printed thereon. Accordingly, half (corresponding to a nozzle group of #8Δ to #14Δ) of nozzles in the white nozzle row W (corresponding to a second nozzle row) on the upstream side of the transport direction (corresponding to the other direction of the predetermined direction) serve as use nozzles for printing the background image, and half (corresponding to a nozzle group of #1• to #7•) of the nozzles in the color nozzle row Co on the downstream side of the transport direction serve as use nozzles for printing the color image. Moreover, in the front and white use mode, ink is not ejected from half (#1 to #7) of the nozzles in the white nozzle row W on the downstream side of the transport direction and from half (#8 to #14) of the nozzles in the color nozzle row Co on the upstream side of the transport direction. In addition, since FIG. 9 illustrates band printing, an amount of the medium transported once corresponds to a width in the transport direction of the image formed in one pass. In the white use mode, since two types of images are formed in one pass, the amount of the medium transported once corresponds to a width in the transport direction of the background image or the color image formed in one pass. Therefore, in FIG. 9, the amount of the medium transported once is a length "7D" of the half of the nozzle row (the total length of the seven nozzles).

That is, in the front print and white use mode, an operation of forming images using the use nozzles in the white nozzle row W on the upstream side of the transport direction and the use nozzles in the color nozzle row Co on the downstream side of the transport direction, and an operation of transporting the medium by only the transport amount 7D are repeatedly performed. As a result, the predetermined area of the medium is opposed to the use nozzles (#8 to #14) in the white nozzle row W on the upstream side of the transport direction, and the background image is printed on the predetermined area of the medium. Thereafter, as the medium is transported to the downstream side of the transport direction, the predetermined area of the medium is opposed to the use nozzles (#1 to #7) in the color nozzle row Co on the downstream side of the transport direction, and the color image is printed on the background image in the predetermined area of the medium.

On the contrary, in the rear print and white use mode, as illustrated in FIG. 10, half (#1Δ to #7Δ) of the nozzles in the white nozzle row W on the downstream side of the transport direction serve as use nozzles for printing the background image, and half (#8• to #14•) of the nozzles in the color nozzle row Co on the upstream side of the transport direction serve as use nozzles for printing the color image. In addition, the amount of the medium transported once is the length 7D of the half of the nozzle row. As a result, the predetermined area of the medium is first opposed to the use nozzles (#8 to #14) in the color nozzle row Co on the upstream side of the transport direction, and the color image is printed on the predetermined area of the medium. Thereafter, as the medium is transported to the downstream side of the transport direction, the predetermined area of the medium is opposed to the use nozzles (#1 to #7) in the white nozzle row W on the downstream side of the transport direction, and the background image is printed on the color image in the predetermined area of the medium.

In addition, printed examples in which the image is printed by selecting one from the forward path and the return path in the case where the background image is printed only with the white ink will now be described.

Figure 11A:
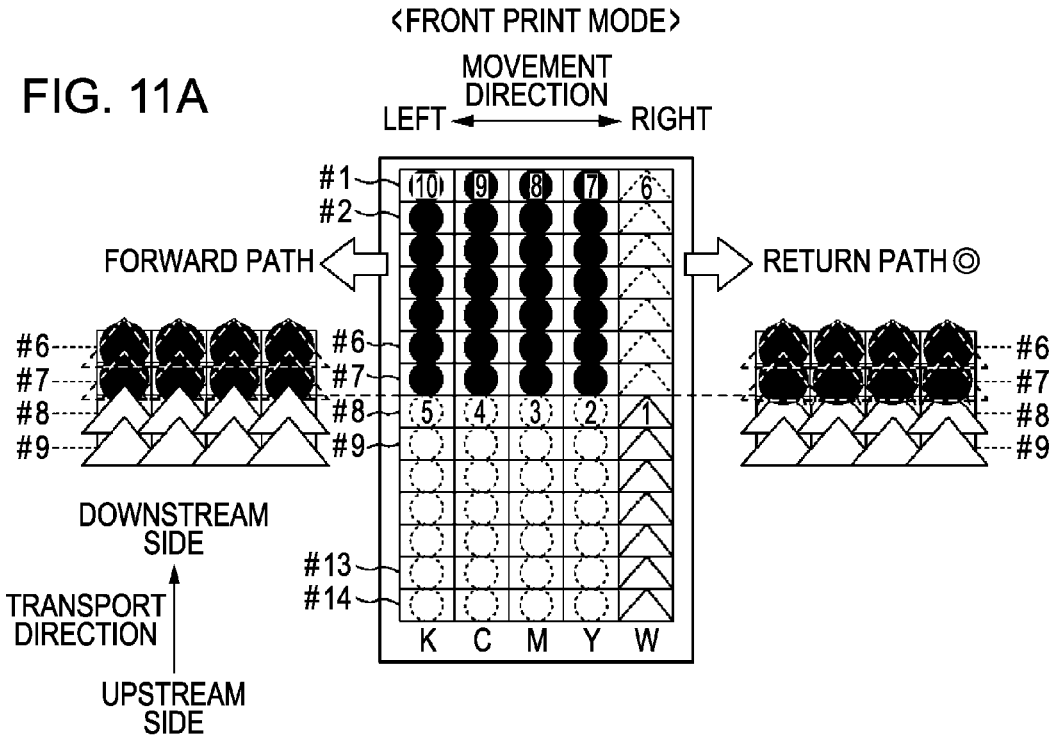
FIGS. 11A and 11B are diagrams for explaining directions of the unidirectional printing suitable for the front print mode and the rear print mode in the white use mode.
Figure 11B:
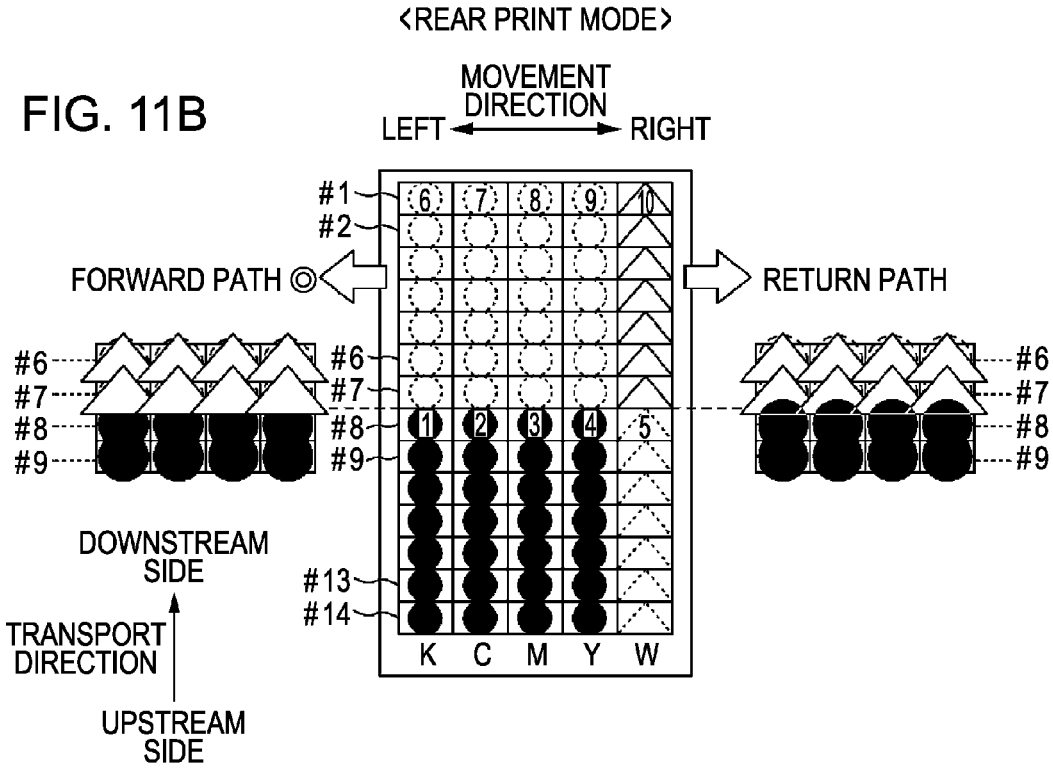

FIGS. 11A and 11B are diagrams for explaining directions of the unidirectional printing suitable for the front print mode and the rear print mode in the white use mode. In the unidirectional printing of the above embodiment, the image is formed during the forward path (during the movement of the head 41 from the home position); however, the invention is not limited thereto. Even in the unidirectional printing, depending on the print mode, the image may be formed during the forward path, or the image may be formed in the return path.

FIG. 11A illustrates printing performed in the front print and white use mode. In the figure, the number of nozzles that belong to a single nozzle row is set to 14, and the center part of the figure illustrates the nozzles used in the front print and white use mode. In the front print and white use mode, the half #8 to #14 of the nozzles in the white nozzle row W on the upstream side of the transport direction and the half #1 to #7 of the nozzles in the color nozzle rows (YMCK) on the downstream side of the transport direction are used. Here, a dot formation method of pixels (pixels to which the nozzles #6 to #9 can be allocated in the figure) corresponding to the boundary line between the use nozzles for white and the use nozzles for color will be described.

First, the pixels on the boundary line during the forward path are focused on (pixels on the left in the figure). Moreover, dots of the background image are already formed in the pixels corresponding to the nozzles #6 and #7. In the printer 1 of this embodiment, from the left (corresponding to the second direction) of the movement direction of the head 41, a black nozzle row K, a cyan nozzle row C, a magenta nozzle row M, a yellow nozzle row Y, and a white nozzle row W are arrayed in this order. Therefore, during the forward path for the movement from the right to the left in the movement direction, first, dots (•) for the color image are formed in the pixels of the nozzles #6 and #7, and thereafter dots (Δ) for the background image are formed in the pixels of the nozzles #8 and #9. Generally, a dot larger than the area of one pixel at the maximum is formed. Particularly, since the background image is formed by solid coating printing of white color, a dot larger than the pixel is formed. Therefore, in the front print mode, while forming the dots for the background image under (in advance of) the dots for the color image is natural in the front print mode, in the pixels (pixels of the nozzles #7 and #8) on the boundary line between the use nozzles for white and the use nozzles for color, the overlapping order of the dots for the background image and the dots for the color image is reversed. In this case, there is a concern that color tone of only the pixels on the boundary line is different from that of other pixels.

On the other hand, during the return path for the movement from the left to the right in the movement direction, dots (Δ) for the background image are formed in the pixels of the nozzles #8 and #9, and thereafter dots (•) for the color image are formed in the pixels of the nozzles #6 and #7. Therefore, during the return path, in the pixels on the boundary line between the use nozzles for white and the use nozzles for color (the pixels of the nozzles #7 and #8), the dots for the background image are formed under (in advance of) the dots for the color image. Accordingly, in the pixels on the boundary line and other pixels, the overlapping order of the dots for the background image and the dots for the color image can be uniform, so that a change in color tone of the pixels on the boundary line can be prevented. That is, when the unidirectional printing is performed in the front print and white use mode, the image may be formed on the return path, and the position of the head 41 may be returned on the forward path.

In addition, numbers are shown inside the nozzles #1 and #8 of FIG. 11A. Moreover, the nozzles #1 and #8 may be allocated to the same pixel. In addition, the numbers inside the nozzles represent the order of the nozzles to which a predetermined pixel is opposed in the case where the image formation operation is performed on the return path and the returning operation of the head 41 is performed on the forward path. In order to form the image on the return path, in the pass of the same return path, first, the use nozzle #8 for white on the upstream side of the transport direction is opposed to a predetermined pixel to form dots, and then the non-use nozzles #8 of yellow, magenta, cyan, and black are opposed to the predetermined pixel in this order to form dots. Thereafter, the medium is transported to the downstream side, and in the pass of the subsequent return path, first, the non-use nozzle #1 of white on the downstream side of the transport direction is opposed to a predetermined pixel, and then the use nozzle #1 of each color is opposed to the predetermined pixel to form dots.

That is, when the unidirectional printing is performed in the front print (corresponding to the first mode) and white use mode, as the image is formed on the return path (as the image is formed during the movement to the right (in the first direction) of the movement direction), dots for the background image are formed relatively early in the pass in which the background image is formed on the predetermined area of the medium, and dots for the color image are formed relatively late in the pass in which the color image is formed. As a result, the drying time of the background image can further be lengthened. On the contrary, when the image is formed during the forward path, the predetermined area of the medium is opposed to the use nozzles #8 for white after the non-use nozzles #8 for color, and thus the use nozzles #1 for color are opposed thereto in advance of the non-use nozzle #1 for white, so that the drying time of the white ink is shortened. For this reason, it can be said that forming the image on the return path is preferable in the case where the unidirectional printing is performed in the front print and white use mode.

FIG. 11B illustrates printing performed in the rear print (corresponding to the second mode) and white use mode. In the rear print and white use mode, the half #1 to #7 of the nozzles in the white nozzle row W on the downstream side of the transport direction and the half #8 to #14 of the nozzles in the color nozzle rows (YMCK) on the upstream side of the transport direction are used. In the rear print and white use mode, as the image is formed during the forward path (the image is formed during the movement to the left of the movement direction (in the second direction)), as illustrated in the left pixels in the figure, the dots (•) for the color image are formed in advance of (under) the dots (Δ) for the background image in the pixels (the pixels of the nozzles #7 and #8) on the boundary line between the use nozzles for white and the use nozzles for color. On the other hand, as the image is formed during the return path, as illustrated in the right pixels in the figure, the dots for the background image are formed in advance of the dots for color image in the pixels on the boundary line. Since it is natural to form the dots (•) for the color image in advance of the dots (Δ) for the background image in the rear print mode, in the case where the unidirectional printing is performed in the rear print and white use mode, the image may be formed on the forward path, and the position of the head 41 may be return on the return path. As a result, the overlapping order of the dots for the background image and the dots for the color image can be uniform over the entire area of the image, thereby uniformizing color tone.

In addition, numbers inside the nozzles #1 and #8 of FIG. 11B represent the order of the nozzles to which a predetermined pixel is opposed in the case where the image formation operation is performed on the forward path and the returning operation of the head 41 is performed on the return path. When the unidirectional printing is performed in the rear print and white use mode, as the image is formed on the forward path, the dots for the color image are formed relatively early in the pass in which the color image is formed on the predetermined area of the medium, and dots for the background image are formed relatively late in the pass in which the background image is formed thereon. As a result, the drying time of the color image can be further lengthened, thereby suppressing oozing of the image. Accordingly, in the case where the unidirectional printing is performed in the rear print and white use mode, forming the image on the forward path is preferable.

In addition, in the above-described embodiments, the color image is printed with only the four color inks (YMCK); however, the invention is not limited thereto. For example, the color image may be printed using the white ink as well as the four color inks. In this case, in the front print and white use mode described above with reference to FIG. 5, the color image is printed using the half (#1 to #7) of the nozzles in the color nozzle row Co and the white nozzle row W on the downstream side of the transport direction. On the other hand, in the rear print and white use mode described above with reference to FIG. 6, the color image is printed using the half of the nozzles (#8 to #14) in the color nozzle row Co and the white nozzle row W on the upstream side of the transport direction. As described above, the position in the transport direction of the nozzles in the color nozzle row Co for printing the color image and the position in the transport direction of the nozzles in the white nozzle row W for printing the color image are aligned. Then, to print the color image, the color ink and the white ink are ejected to the predetermined area of the medium in the same pass. As described above, as the color image is printed by adding the white ink to the color ink, an image which has high brightness and reproduces colors with high chroma can be printed.

Other Embodiments

In each of the embodiments described above, the main parts of a printing system having the ink jet printer has been described; however, the start of setting the printing method or the like is also included. In addition, the embodiments are provided for easy understanding of the invention and are not intended to limit the invention. Modifications and improvements can be made without departing from the spirit and scope of the invention, and it is needless to say that equivalent matters are included in the invention. Particularly, the embodiments described later are also included in the invention.

Ink and Recording Medium

In this embodiment, ink and a medium having ink absorbency to absorb the ink (ink absorbent recording medium) are used. As the ink absorbent recording medium, a recording medium made of a base material having ink absorbency or a recording medium provided with an ink receptive layer in a base material may be used. As the base material having ink absorbency, there are paper, fabric, and the like. The ink may be ink absorbed by an absorbent medium and may include an evaporative solvent to ensure absorbency to the ink absorbent medium. In addition, "water-based" ink containing at least water as a solvent is particularly preferable. As other components of the ink, there are dyes or pigments as a color material. In addition, for discharge stability of the ink jet head, the ink may contain a water-soluble organic solvent or may contain moisturizer, penetration enhancer, pH adjuster, insect repellent, ultraviolet absorber, and the like as needed. As such color ink, for example, inks disclosed in JP-A-2008-81693, JP-A-2005-105135, and JP-A-2003-292834 may be used.

The recording medium absorbs the solvent of the ink composition to fix the color material of the ink composition. For example, a medium which uses a base material such as paper or fabric which absorbs ink or a medium in which a base material that absorbs ink or a base material that does not absorb ink is provided with an ink receptive layer for absorbing ink may be used. In the case where a medium having transparency is used, recording media disclosed in JP-A-2009-925, JP-A-9-99634, and JP-A-9-208870 may be used.

As the ink receptive layer, a well-known ink receptive layer which is generally provided on the recording medium for an ink jet recording method may be used. As the well-known ink receptive layer, for example, an ink receptive layer made from resin is known. As examples of the resin used for the ink receptive layer, there are various ink absorbent polymers including a polyvinylpyrrolidone or vinylpyrrolidone/vinyl acetate copolymer as disclosed in JP-A-57-38185 and JP-A-62-184879, a resin composition having polyvinyl alcohol as an agent as disclosed in JP-A-60-168651, JP-A-60-171143, and JP-A-61-134290, an olefin/vinyl alcohol copolymer or a styrene/maleic anhydride copolymer as disclosed in JP-A-60-234879, a cross-linked material of polyethylene oxide and isocyanate as disclosed in JP-A-61-74879, a mixture of carboxymethylcellulose and polyethylene oxide as disclosed in JP-A-61-181679, a polymer having methacrylamide grafted to polyvinyl alcohol as disclosed in JP-A-61-132377, an acrylic polymer having carboxyl group as disclosed in JP-A-62-220383, a polyvinyl acetal polymer as disclosed in JP-A-4-214382, a crosslinkable acrylic polymer as disclosed in JP-A-4-282282 and JP-A-4-285650, and the like.

In addition, as the well-known ink receptive layer, an ink receptive layer in which a polymer matrix made of a crosslinkable polymer and an absorbent polymer are used in combination is disclosed in JP-A-4-282282 and JP-A-4-285650. Further, an ink receptive layer using hydrated alumina (cationic hydrated alumina) is known, and for example, recording media in which fine pseudo-boehmite hydrated alumina is coated on the surface of a base material with a water-soluble binder are disclosed in JP-A-60-232990, JP-A-60-245588, JP-B-3-24906, JP-A-6-199035, and JP-A-7-82694. In addition, for example, in JP-A-10-203006, an ink receptive layer using synthetic silica having a primary particle size of 3 to 30 nm according to a gas-phase process is disclosed. Furthermore, in JP-A-2001-328344, an ink receptive layer containing an inorganic pigment and a polymer adhesive is disclosed. According to the embodiments of the invention, a film base material provided with such an ink receptive layer may be used.

According to the embodiments of the invention, as a white ink composition for the background image, an arbitrary white ink composition which is typically used in an ink jet recording method may be used. As such white pigments, for example, there are inorganic white pigments, organic white pigments, and white hollow polymer particles. As the white ink composition, a water-based ink composition containing the hollow polymer particles as a colorant component may be used.

As the inorganic white pigment, there are sulfate of alkaline earth metals such as barium sulfate, carbonate of alkaline earth metals such as calcium carbonate, fine powder silicic acid, silicas such as synthetic silicate, calcium silicate, alumina, hydrated alumina, titanium oxide, zinc oxide, talc, clay, and the like. Particularly, titanium oxide is known as a white pigment having preferable masking properties, colorability, and a dispersion particle size.

As the organic white pigment, there are organic compound salts described in JP-A-11-129613 and alkylene-bis-melamine derivatives described in JP-A-11-140365 and JP-A-2001-234093. As specific products of the white pigment, there are ShigenoxOWP, ShigenoxOWPL, ShigenoxFWP, ShigenoxFWG, ShigenoxUL, and ShigenoxU (product names, manufactured by Hakkol Chemical Co., Ltd.).

As the hollow polymer particles contained as the colorant component, for example, particles which have outer diameters of about 0.1 to 1 μm and inner diameters of about 0.05 to 0.8 μm, are not soluble in the solvent of the white ink composition, and do not chemically react with other components, for example, the binder resin component are needed. The hollow polymer particle is made of a synthetic polymer to allow liquid to penetrate its wall, and liquid comes in and out of a space of a center part of the hollow polymer particle by penetrating the wall. Therefore, the space of the center part of the hollow polymer particle is filled with a solvating medium in the ink composition state, and a specific gravity of the hollow polymer particle and a specific gravity of the ink composition become substantially the same, so that the hollow polymer particles are stably dispersed in the ink composition. On the other hand, when the ink composition is printed on a print surface and dried, the space of the center part of the hollow polymer particle is substituted for air, and thus incident light at the resin and the space part diffuses, so that white color is actually shown.

In addition, as described above, the hollow polymer particle contains liquid therein before printing and may be of a type in which liquid that penetrates into the particle is diffused through the wall of the particle after printing such that pores of the particle are filled with air or a completely sealed type in which air is contained inside from the initial state. It is preferable that the hollow polymer particle used for the white ink composition be not precipitated in the ink composition, so that the hollow polymer particle has substantially the same specific gravity as the ink composition solution. Therefore, as needed, the specific gravity of the ink composition solution may be controlled using a specific gravity adjuster such as glycerol.

As commercialized products of the hollow polymer particle which satisfies the properties, for example, there are Ropaque OP-62 commercially available by Rohm and Haas Company, and the like. This is an aqueous dispersion containing 38% by weight of the hollow polymer particles made of a copolymer of acrylic resin and styrene. The particle has an inner diameter of about 0.3 μm and an outer diameter of about 0.5 μm and is filled with water.

In addition, the hollow polymer particle may be obtained by a well-known manufacturing method, for example, a method disclosed in U.S. Pat. No. 4,089,800. The hollow polymer particle is substantially made of an organic polymer and exhibits thermoplastic properties. As the thermoplastic resin used for manufacturing the hollow polymer particles, preferably, there are a copolymer of cellulose derivative, acrylic resin, polyolefin, polyamide, polycarbonate, polystyrene, styrene, and other vinyl monomers, a vinyl polymer such as a homopolymer or a copolymer of vinyl acetate, vinyl alcohol, vinyl chloride, and vinyl butyral, a diene homopolymer or copolymer, and the like. As a particularly preferable thermoplastic polymer, copolymers such as a copolymer of 2-ethylhexyl acrylate or a copolymer of methyl methacrylate, copolymers of styrene and other vinyl monomers such as acrylonitrile.

A content of the hollow polymer particles in the white ink composition used in the embodiments of the invention is, for example, in the range of 0.1% to 20% by weight. When the content of the hollow polymer particles is equal to or greater than 0.1% by weight, sufficient whiteness can be obtained. On the other hand, when the content is equal to or less than 20% by weight, a sufficient amount of ink binder resin components needed to ensure a viscosity required for the ink composition for ink jet printing can be contained, and consequently, sufficient printing adhesion properties can be ensured.

According to the embodiments of the invention, the white pigments may be used singly or in combination. The dispersion of the pigments may be performed using a ball mill, a sand mill, an attoliter, a roll mill, an agitator, a Henschel mixer, a colloid mill, an ultrasonic homogenizer, a pearl mill, a wet jet mill, a paint shaker, or the like. In addition, a dispersant may be added when the dispersion of the pigments is performed.

The white ink composition used in the embodiments of the invention, as well as the white colorant components, various components typically contained in the ink composition for ink jet printing, for example, resin components, dispersant components, solvating medium components (particularly water) may be contained. Moreover, in the specification, the solvating medium and the solvent have the same meaning. In addition, as the white ink composition containing the hollow polymer particles as the white colorant, a composition described in Japanese Patent No. 3562754 or Japanese Patent No. 3639479 may be used.

A non-white ink composition for the color image used in the embodiments of the invention, for example, there are color ink compositions, black ink compositions, or gray ink compositions. In addition, as the color ink compositions, for example, there are a cyan ink composition, a magenta ink composition, a yellow ink composition, a light cyan ink composition, and a light magenta ink composition, and further, a red ink composition, a green ink composition, and a blue ink composition, and the like. As the non-white ink composition, one or more kinds selected from the group consisting of the various ink compositions described above may be used.

As the non-white ink composition, an arbitrary non-white ink composition which is typically used in an ink jet recording method and a water-based ink composition containing dyes or pigments as the colorant component may be used. Particularly, an ink composition which exhibits good properties (color developing property or fixing property) for a transparent film base material or an ink receptive layer.

When the above-described ink and recording medium are used in the embodiments of the invention, as the time interval between the preceding image formation and the subsequent image formation is provided to be long as described in the above embodiments, the drying time of ink can be lengthened, thereby preventing oozing of the image or mixed colors. Here, the ink and the recording medium used in the embodiments of the invention are not limited to those described above. By providing a long time interval between the preceding image formation and the subsequent image formation, a time taken to fix the components in ink to the recording medium may be provided, which is desirable. That is, any ink or recording medium can be used as long as oozing of the image or mixed colors can be prevented by providing a long time interval between the preceding image formation and the subsequent image formation by the above-described embodiment.

Upper End and Lower End Printing

When upper end printing or lower end printing is performed on a medium, there may be a case where a transport amount of the medium is shortened compared to typical printing. When the unidirectional printing is performed in the white use mode, the sum of the transport time of the medium and the returning time of the head 41 corresponds to the drying time of the image printed in advance. Therefore, when the transport amount of the medium is shortened during the upper end or lower end printing, the transport time of the medium is shortened, and the drying time of the image printed in advance is also shortened. When variations in the drying time are causes of density unevenness of the image. Here, the transport amount of the medium during the upper end or lower end printing is shortened and the drying time is shortened compared to the typical printing, during the upper end or lower end printing, for example, a downtime may be provided after the image formation operation. Accordingly, by uniformizing the drying time during the upper end or lower end printing and the drying time during the typical printing, the density unevenness of the image can be suppressed.

Background Image

In the above-described embodiments, the background image is printed with the white ink; however, the invention is not limited thereto, and the background image may be printed with color ink (for example, metallic ink) other than the white ink. In addition, the invention is not limited to the case in which the background image is printed with only the white ink, and the background image of which the tone of white color is adjusted by mixing the white ink with other color inks may be printed. In addition, the color image may be printed by adding white ink to the four color inks (YMCK). Even in this case, when two images are printed to be overlapped, the unidirectional printing may be set.

Printer

In the above-described embodiments, the printer which repeatedly performs the operation of forming an image on a single cut paper while moving the head 41 in the movement direction and the operation of transporting the single cut paper with respect to the head in the transport direction which intersects the movement direction is exemplified; however, the invention is not limited thereto. For example, a printer which repeatedly performs an operation of forming an image on a continuous paper transported in a print area while moving the head unit 40 including (a plurality of) the heads 41 in the medium transport direction and an operation of moving the head unit 40 in a paper width direction to form the image and thereafter transports a part of the medium on which the image is not printed yet to the print area may be used.

Fluid Ejecting Apparatus

In the above-described embodiments, the ink jet printer is exemplified as the fluid ejecting apparatus; however, the invention is not limited thereto. Any industrial apparatus other than the printer (printing apparatus) may be applied as long as it is a fluid ejecting apparatus. For example, a printing apparatus for attaching a pattern to a fabric, a color filter manufacturing apparatus, a display manufacturing apparatus for manufacturing an organic EL display or the like, a DNA chip manufacturing apparatus for manufacturing a DNA chip by applying a solution with dissolved DNA to a chip, and the like may be applied with the invention.

In addition, a fluid ejecting method for ejecting fluid from nozzles may be a piezo method of applying a voltage to a drive element (piezo element) to expand and contract a pressure chamber thereby ejecting fluid or a thermal method of generating bubbles in the nozzles using heat-generating elements and ejecting liquid due to the bubbles.

In addition, ink ejected from the head 41 may be an ultraviolet curable ink which cures when ultraviolet rays are irradiated.

What is claimed is:

1. A fluid ejecting apparatus comprising:

a first nozzle row in which nozzles for ejecting a first fluid are lined up in a predetermined direction;

a second nozzle row in which nozzles for ejecting a second fluid are lined up in the predetermined direction and which is lined up in a movement direction intersecting the predetermined direction with respect to the first nozzle row; and a control unit which sets a uni-directional printing or a bi-directional printing, to form an image on a medium, wherein, the uni-directional printing includes:

a first ejecting operation of ejecting fluid from the nozzles while relatively moving relative positions of the first and second nozzle rows and the medium in one direction of the movement direction;

and a moving operation of relatively moving the relative positions of the first and second nozzle rows and the medium in one direction of the predetermined direction;

wherein, a bi-directional printing includes:

a second ejecting operation of ejecting fluid from the nozzles while relatively moving the relative positions of the first and second nozzle rows and the medium in both directions of the movement direction;

and the moving operation;

wherein the control unit sets the uni-directional printing when formation of a main image with the first fluid by a nozzle group of a part of the first nozzle row and formation of a background image with the second fluid by a nozzle group of a part of the second nozzle row are performed to overlap the main image and the background image with each other on the medium, wherein, in the uni-directional printing, a time needed to perform a returning operation of relatively moving the relative positions of the first and second nozzle rows and the medium in the other direction of the movement direction and not ejecting fluid from the nozzle is longer than a time needed to perform the moving operation once.

2. The fluid ejecting apparatus according to claim 1, wherein, in the uni-directional printing, a time needed to perform a returning operation of relatively moving the relative positions of the first and second nozzle rows and the medium in the other direction of the movement direction and not ejecting fluid from the nozzles is equal to or shorter than a time needed to perform the ejecting operation once, and is longer than a time needed to relatively move the relative positions of the first and second nozzle rows and the medium in the one direction of the predetermined direction by a length of the nozzle group in the predetermined direction.

3. The fluid ejecting apparatus according to claim 2, wherein a time needed to perform the returning operation in the uni-directional printing is longer than a time needed to relatively move the relative positions of the first and second nozzle rows and the medium in the one direction of the predetermined direction by a length in the predetermined direction of at least one of the nozzle rows of the first and second nozzle rows.

4. The fluid ejecting apparatus according to claim 1, wherein, in the uni-directional printing, the returning operation of relatively moving the relative positions of the first and second nozzle rows and the medium in the other direction of the movement direction and not ejecting fluid from the nozzles is not performed simultaneously with the moving operation.

5. The fluid ejecting apparatus according to claim 1, wherein the control unit sets the bi-directional printing in the case where the main image is formed on the medium without forming the background image.

6. The fluid ejecting apparatus according to claim 1, wherein the second nozzle row is positioned closer to a first direction side of the movement direction than the first nozzle row, when the main image and the background image are to be formed on the medium to be overlapped, the control unit sets one of a first mode in which the background image is formed in advance of the main image on the predetermined area of the medium, and a second mode in which the main image is formed in advance of the background image on the predetermined area of the medium, when the first mode is set, fluid is ejected from the nozzles when the relative positions of the first and second nozzle rows and the medium are relatively moved in the first direction of the movement direction, and when the second mode is set, fluid is ejected from the nozzles when the relative positions of the first and second nozzle rows and the medium are relatively moved in a second direction of the movement direction.

7. The fluid ejecting apparatus according to claim 1, wherein the background image is formed using the nozzles in the first nozzle row of which a position in the predetermined direction is the same as that of the nozzle group of the part of the second nozzle row for forming the background image, in the case where the formation of the main image and the formation of the background image are performed to overlap the main image and the background image with each other on the medium.

8. A fluid ejecting method used with a fluid ejecting apparatus which has a first nozzle row in which nozzles for ejecting a first fluid are lined up in a predetermined direction, and a second nozzle row in which nozzles for ejecting a second fluid are lined up in the predetermined direction and which is lined up in a movement direction intersecting the predetermined direction with respect to the first nozzle row, the method comprising:

setting a uni-directional printing or a bi-directional printing, to form an image on a medium, wherein, the uni-directional printing includes:

a first ejecting operation of ejecting fluid from the nozzles while relatively moving relative positions of the first and second nozzle rows and the medium in one direction of the movement direction;

and a moving operation of relatively moving the relative positions of the first and second nozzle rows and the medium in one direction of the predetermined direction;

wherein, a bi-directional printing includes:

a second ejecting operation of ejecting fluid from the nozzles while relatively moving the relative positions of the first and second nozzle rows and the medium in both directions of the movement direction;

and the moving operation;

wherein the control unit sets the uni-directional printing when formation of a main image with the first fluid by a nozzle group of a part of the first nozzle row and formation of a background image with the second fluid by a nozzle group of a part of the second nozzle row are performed to overlap the main image and the background image with each other on the medium, wherein, in the uni-directional printing, a time needed to perform a returning operation of relatively moving the relative positions of the first and second nozzle rows and the medium in the other direction of the movement direction and not ejecting fluid from the nozzle is longer than a time needed to perform the moving operation once.

* * * * *